US007225859B2

(12) United States Patent
Mochizuki et al.

(10) Patent No.: US 7,225,859 B2
(45) Date of Patent: Jun. 5, 2007

(54) HEAT EXCHANGER ELEMENT AND HEAT EXCHANGER MEMBER FOR A STIRLING CYCLE REFRIGERATOR AND METHOD OF MANUFACTURING SUCH A HEAT EXCHANGER MEMBER

(75) Inventors: Hitoshi Mochizuki, Yamatokoriyama (JP); Yoshiaki Ogura, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 212 days.

(21) Appl. No.: 10/362,928

(22) PCT Filed: Aug. 30, 2001

(86) PCT No.: PCT/JP01/07515

§ 371 (c)(1),
(2), (4) Date: Aug. 5, 2003

(87) PCT Pub. No.: WO02/21056

PCT Pub. Date: Mar. 14, 2002

(65) Prior Publication Data

US 2004/0026067 A1 Feb. 12, 2004

(51) Int. Cl.
*F28D 17/00* (2006.01)

(52) U.S. Cl. ..... 165/10; 60/526

(58) Field of Classification Search ..... 165/10, 165/154

See application file for complete search history.

(56) References Cited

U.S. PATENT DOCUMENTS 2,413,179 A * 12/1946 Grandmont et al. ..... 165/185
3,474,513 A * 10/1969 Allingham ..... 29/890.036
3,716,750 A * 2/1973 Nakada et al. ..... 315/39.71
4,305,457 A * 12/1981 Cozzolino ..... 165/154
4,373,577 A 2/1983 McMillen
5,561,338 A * 10/1996 Roberts et al. ..... 313/46
5,672,931 A * 9/1997 Kiss et al. ..... 313/44
RE35,890 E * 9/1998 So ..... 165/109.1
6,095,236 A * 8/2000 Kuhler ..... 165/80.1
6,404,637 B2 * 6/2002 Hutchison et al. ..... 361/704
6,557,626 B1 * 5/2003 O'Sullivan et al. ..... 165/121
6,657,862 B2 * 12/2003 Crocker et al. ..... 361/697
6,851,467 B1 * 2/2005 Bamford et al. ..... 165/80.3

FOREIGN PATENT DOCUMENTS

| | | | |
|---|---|---|---|
| EP | 0314255 | A | 5/1989 |
| GB | 581586 | A | 10/1946 |
| GB | 2176058 | B | 12/1986 |
| JP | 5-280815 | A | 10/1993 |
| JP | 8-86526 | A | 4/1996 |
| JP | 11-223399 | A | 8/1999 |
| JP | 2001-91075 | A | 4/2001 |
| WO | WO 86/02772 | A1 | 5/1986 |

* cited by examiner

*Primary Examiner*—Allen J. Flanigan
(74) *Attorney, Agent, or Firm*—Birch, Stewart, Kolasch & Birch, LLP

(57) ABSTRACT

A heat exchanger element for a Stirling cycle refrigerator is produced by integrally forming an annular corrugate fin that is produced by forming a sheet material, corrugated so as to have a large number of grooves, into a cylindrical shape with the grooves parallel to an axis of the cylindrical shape and an inner ring-shaped member that is placed in contact with the inner periphery of the annular corrugate fin. A heat rejector or heat absorber for a Stirling cycle refrigerator is produced by inserting this heat exchanger element into the hollow portion of a tubular body.

2 Claims, 26 Drawing Sheets

HEAT EXCHANGER ELEMENT AND HEAT EXCHANGER MEMBER FOR A STIRLING CYCLE REFRIGERATOR AND METHOD OF MANUFACTURING SUCH A HEAT EXCHANGER MEMBER

This application is the national phase under 35 U.S.C. § 371 of PCT International Application No. PCT/JP01/07515 which has an International filing date of Aug. 30, 2001, which designated the United States of America.

BACKGROUND OF THE INVENTION

1. Field of the Invention

The present invention relates to a heat exchanger member, such as a heat absorber or heat rejector, provided in a Stirling cycle refrigerator, to a heat exchanger element for use in such a heat exchanger member, and to a method of manufacturing such a heat exchanger member.

2. Description of the Related Art

First, a typical configuration of a free-piston-type Stirling cycle refrigerator exploiting a Stirling cycle will be described. FIG. 29 is a diagram schematically showing a section, as seen from the side, of a free-piston-type Stirling cycle refrigerator. Inside a cylinder 1, a heat absorber 2 acting as a low-temperature portion, a regenerator 3, and a heat rejector 4 acting as a high-temperature portion are arranged in this order. The heat absorber 2 and the heat rejector 4 are each built as a heat exchanger member composed of a tubular body 21 or 41 having a heat exchanger element 22 or 42 fitted on the inner surface thereof at one end. Inside the cylinder 1, the heat exchanger elements 22 and 42 are each contiguous to the regenerator 3.

Inside the cylinder 1 are also arranged a displacer 6 firmly fitted to one end of a displacer rod 5, and a piston 7 through which the displacer rod 5 is placed. The other end of the displacer rod 5 is connected to a spring 8. Inside the cylinder 1, the displacer 6 and the piston 7 create an expansion space 9 in the heat absorber 2 and a compression space 10 in the heat rejector 4. The expansion space 9 and the compression space 10 communicate with each other through the regenerator 3, and thereby form a closed circuit.

Now, how this free-piston-type Stirling cycle refrigerator operates will be described. The piston 7 is made to reciprocate along the axis of the cylinder 1 with a predetermined period by an external power source, such as a linear motor (not shown). The compression space 10 is filled with working gas, such as helium, beforehand.

As the piston 7 moves, the working gas in the compression space 10 is compressed. This causes the working gas to flow through the heat exchanger element 42 then through the regenerator 3 into the expansion space 9 (as indicated by broken-line arrows A in the figure). Meanwhile, the working gas first releases heat in the heat rejector 4, by exchanging the heat produced therein as a result of compression with the air outside, and is then precooled as it passes through the regenerator 3, by receiving the cold accumulated in the regenerator 3 beforehand.

When the working gas flows into the expansion space 9, it presses the displacer 6 rightward against the spring 8. Thus, the working gas expands, and produces cold therein. When the working gas expands to a certain degree, the resilience of the spring 8 presses the displacer 6 back in the opposite direction.

As a result, the working gas in the expansion space 9 flows through the heat exchanger element 22 of the heat absorber 2 and then through the regenerator 3 back to the compression space 10 (as indicated by solid-line arrows A'). Meanwhile, the working gas first absorbs heat in the heat exchanger element 22, by exchanging heat with the air outside, and is then preheated as it passes through the regenerator 3, by receiving the heat accumulated in the regenerator 3 beforehand. The working gas back in the compression space 10 is then compressed again by the piston 7.

Through the repetition of this cycle of events, cryogenic cold is obtained in the heat absorber 2. Here, the larger the amount of heat absorbed in the heat exchanger element 22 of the heat absorber 2 and the amount of heat released in the heat exchanger element 42 of the heat rejector 4, the better. This helps increase the efficiency with which the regenerator 3 precools and preheats the working gas, and thus helps reduce the burden on the regenerator 3, leading to better chilling performance of the Stirling cycle refrigerator.

Next, the heat rejector 4 acting as the high-temperature-side heat exchanger member of the Stirling cycle refrigerator described above will be described with reference to FIG. 30. It is to be understood that, although the following description deals only with the heat rejector 4 and its heat exchanger element 42, the heat absorber 2 acting as the low-temperature-side heat exchanger member and its heat exchanger element 22 are configured in the same manner.

As FIG. 30 shows, this heat exchanger element 42 is built as an annular corrugate fin 421 produced by forming a corrugated sheet material into a cylindrical shape. Thus, the heat exchanger element 42 has a rugged surface, with a large number of axially-extending straight V-shaped grooves 421*a* formed at regular intervals.

Here, the portions of the heat exchanger element 42 which protrude toward the center of the body 41 of the heat rejector 4 are referred to as the bottoms 421*b* of the individual grooves 421*a*, and the portions of the heat exchanger element 42 which protrude toward the inner surface of the body 41 are referred to as the tops 421*c* between every two adjacent grooves 421*a*. The diameter of the circle formed by smoothly connecting all the tops 421*c* together (i.e. the external diameter of the annular corrugate fin 421) is substantially equal to the internal diameter of the body 41. The body 41 and the annular corrugate fin 421 are arranged so as to be coaxial with each other.

The inner surface of the body 41 and the tops 421*c* of the annular corrugate fin 421 are firmly fixed together with adhesive or solder. FIG. 31 is an enlarged view of a portion of the annular corrugate fin 421 as seen axially, and shows how it is fixed with adhesive. In this case, first, adhesive 11 is applied thinly to the inner surface of the body 41, and then the annular corrugate fin 421 is inserted into the body 41. Then, with the annular corrugate fin 421 held in the desired position for a while, the adhesive 11 is dried.

On the other hand, FIG. 32 shows how the annular corrugate fin 421 is fixed with solder. In this case, first, the annular corrugate fin 421 is inserted into the body 41. Then, with the annular corrugate fin 421 held in the desired position, solder 12 is applied to where the inner surface of the body 41 makes contact with or comes close to the tops 421*c* of the annular corrugate fin 421.

However, with this conventional heat exchanger member described above, the fixing together of its components with adhesive or solder is performed by hand. Thus, this process takes too much trouble and time, hindering the improvement of productivity and the reduction of manufacturing costs. Moreover, the heat exchanger member thus manufactured is prone to variations in quality, specifically in heat exchange performance, and thus tends to lack in stability and reliability.

Furthermore, as the Stirling cycle refrigerator is used for an extended period, if the annular corrugate fin 421 is damaged, it is impossible to simply remove and replace it. This adds to the economic burden on the user in the event of repair, and is contrary to the general trend toward recycling of resources in view of the global environment.

SUMMARY OF THE INVENTION

The present invention has been made to solve the problems mentioned above. Specifically, according to one aspect of the present invention, a heat exchanger element for a Stirling cycle refrigerator is produced by integrally forming an annular corrugate fin that is produced by forming a sheet material, corrugated so as to have a large number of grooves, into a cylindrical shape with the grooves parallel to the axis of the cylindrical shape and an inner ring-shaped member that is placed in contact with an inner periphery of the annular corrugate fin.

Integrally forming the annular corrugate fin and the inner ring-shaped member helps increase the area of contact between them and thereby enhance heat conductivity. Moreover, their integration makes the handling of the heat exchanger element easy, and makes the repair, by replacement, of the heat exchanger element possible. This makes the heat exchanger element very economical and recyclable. The integration is achieved by a bonding means, such as brazing or soldering.

A heat exchanger member according to the present invention is produced by inserting the above-described heat exchanger element for a Stirling cycle refrigerator into a hollow portion of a tubular body. In this case, the internal diameter of the body may be made slightly smaller than the external diameter of the heat exchanger element. This makes it possible to fit the heat exchanger element into the body by press fitting, i.e., without bonding or welding. Moreover, at least one end of the body may be tapered so that the wall thickness of the body becomes smaller toward that end along the axis. This permits easy insertion of the heat exchanger element into the body.

Moreover, around the annular corrugate fin, wave-shaped projections may be formed so as to be in close contact with one another and at regular intervals overall, with wave-shaped depressions formed in the inner surface of the body so as to extend axially and correspond to the wave-shaped projections, so that, when the heat exchanger element is inserted into the body, the wave-shaped projections fit into the wave-shaped depressions. This prevents the heat exchanger element from rotating out of position inside the body.

Alternatively, the annular corrugate fin may be produced by forming a linear corrugate fin, of which the endmost sides of the inverted-V-shaped grooves at both ends are longer than the slant sides of the V-shaped grooves in between, into a cylindrical shape, then holding the endmost sides together so that the surfaces of those endmost sides are kept in contact with each other, and then fitting the resulting protruding portion that is formed at the tip of the endmost sides so as to protrude radially out of the outer periphery of the annular corrugate fin into a groove that is formed in the inner surface of the body so as to extend axially. This also prevents the heat exchanger element from rotating out of position inside the body.

This heat exchanger member can be manufactured, for example, by removably putting to the body one end of a tubular guide member tapered so that the internal diameter thereof at one end is substantially equal to the internal diameter of the body and that the wall thickness thereof becomes smaller toward another end, and then inserting the heat exchanger element for a Stirling cycle refrigerator into the body by guiding it through the guide member axially from the other end thereof. In the heat exchanger member manufactured in this way, when the annular corrugate fin is guided through the guide member, its peripheral shape changes, increasing the area of contact with the inner surface of the body. This enhances the heat conduction efficiency of the annular corrugate fin, and thus makes it possible to realize a heat exchanger member excellent in heat exchange performance.

According to another aspect of the present invention, a heat exchanger element for a Stirling cycle refrigerator is produced by integrally forming an annular corrugate fin that is produced by forming a sheet material, corrugated so as to have a large number of grooves, into a cylindrical shape with the grooves parallel to the axis of the cylindrical shape and an outer ring-shaped member that is placed in contact with an outer periphery of the annular corrugate fin.

Integrally forming the annular corrugate fin and the outer ring-shaped member helps increase the area of contact between them and thereby enhance heat conductivity. Moreover, their integration makes the handling of the heat exchanger element easy, and makes the repair, by replacement, of the heat exchanger element possible. This makes the heat exchanger element very economical and recyclable. The integration is achieved by a bonding means, such as brazing or soldering.

A heat exchanger member according to the present invention is produced by inserting the above-described heat exchanger element for a Stirling cycle refrigerator into a hollow portion of a tubular body. In this case, the internal diameter of the body may be made slightly smaller than the external diameter of the heat exchanger element. This makes it possible to fit the heat exchanger element into the body by press fitting, i.e. without bonding or welding. Moreover, at least one end of the body may be tapered so that the wall thickness of the body becomes smaller toward that end along the axis. This permits easy insertion of the heat exchanger element into the body.

The aforementioned annular corrugate fin is produced easily by forming a linear corrugate fin, having contiguous V-shaped grooves, into a cylindrical shape, and then engaging the endmost side of the V-shaped groove at one end of the linear corrugate fin with the endmost side of the inverted-V-shaped groove at the other end thereof.

Alternatively, the annular corrugate fin is produced by forming a linear corrugate fin, having contiguous V-shaped grooves, into a cylindrical shape, and then coupling together the endmost side of the V-shaped groove at one end of the linear corrugate fin and the endmost side of the inverted-V-shaped groove at the other end thereof by performing spot welding on the surfaces of those endmost sides.

Alternatively, the annular corrugate fin is produced by forming a linear corrugate fin, having contiguous V-shaped grooves, into a cylindrical shape, and then coupling together the endmost side of the V-shaped groove at one end of the linear corrugate fin and the endmost side of the inverted-V-shaped groove at the other end thereof by bonding the surfaces of those endmost sides together.

Alternatively, the annular corrugate fin is produced by forming a linear corrugate fin, having contiguous V-shaped grooves, into a cylindrical shape, and then coupling together the endmost side of the V-shaped groove at one end of the linear corrugate fin and the endmost side of the inverted-V-shaped groove at the other end thereof by brazing the surfaces of those endmost sides together.

Alternatively, the annular corrugate fin is produced by forming a linear corrugate fin, having contiguous V-shaped grooves, into a cylindrical shape, then holding the endmost sides of the inverted-V-shaped grooves at both ends of the linear corrugate fin together so that the surfaces of those endmost sides are kept in contact with each other, and then fitting a coupling member having a C-shaped section on the tip of those endmost sides of which the surfaces are kept in contact with each other.

Alternatively, the annular corrugate fin is produced by forming a linear corrugate fin, having contiguous V-shaped grooves, into a cylindrical shape, and then coupling together the endmost sides of the inverted-V-shaped grooves at both ends of the linear corrugate fin by engaging together a slit that is formed in the endmost side at one end of the linear corrugate fin so as to extend from one flank halfway inward and a slit that is formed in the endmost side at the other end of the linear corrugate fin so as to extend from another flank halfway inward.

DETAILED DESCRIPTION OF THE INVENTION

Figure 1:
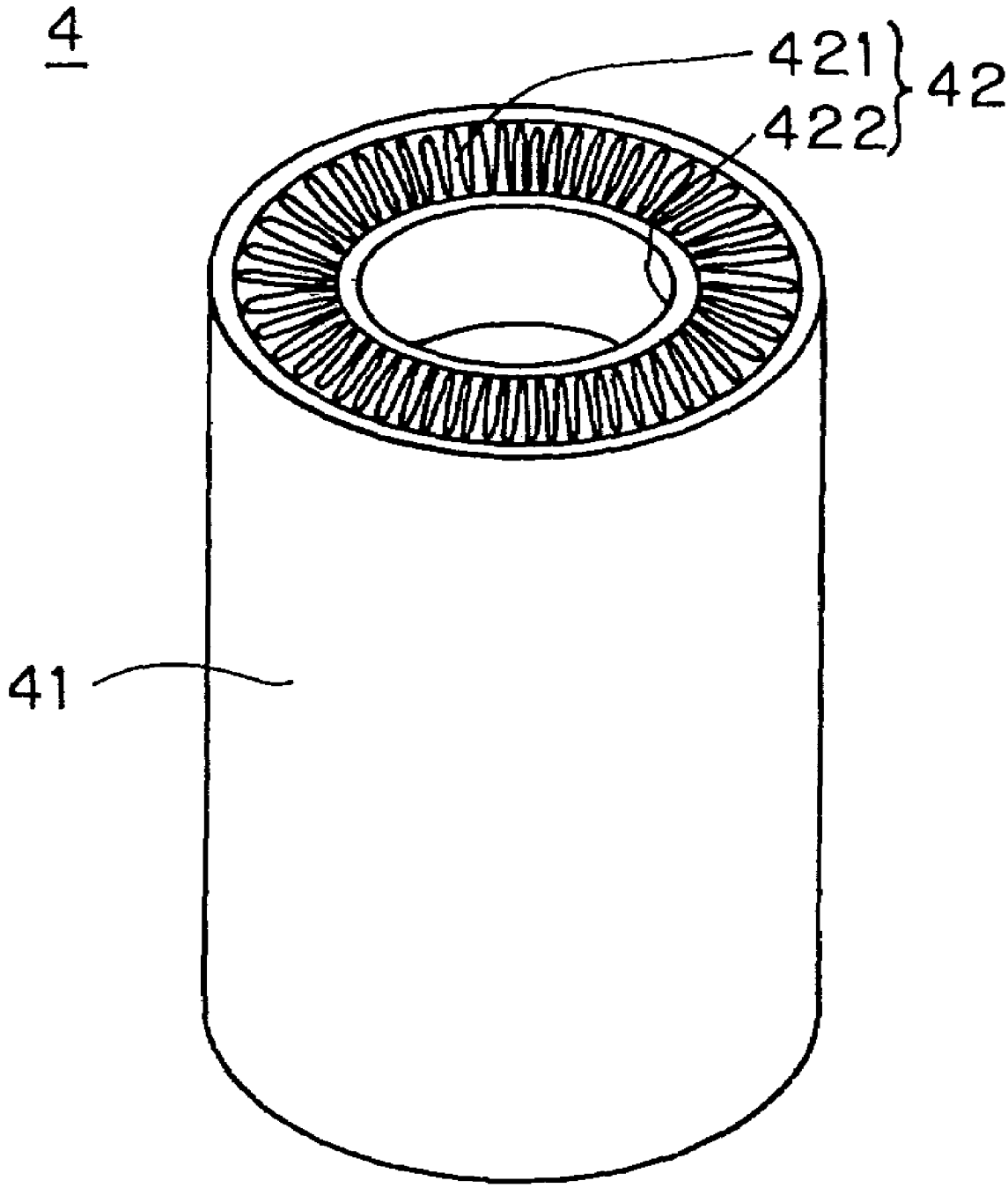
FIG. 1 is an external perspective view of the heat rejector of a first embedment of the invention.

Hereinafter, embodiments of the present invention will be described with reference to the drawings. In the following descriptions, such members as have the same names as in the conventional examples shown in FIGS. 29 to 32 are identified with the same reference numerals. Moreover, in the following descriptions, although only the heat rejector 4 and its heat exchanger element 42 are dealt with, the explanations given as to their configurations, selection of materials for the members constituting them, possible design changes in them, and other aspects of them apply also to the heat absorber 2 and its heat exchanger element 22. Therefore, unless otherwise stated, in the following descriptions, the heat rejector 4 and its heat exchanger element 42 are used interchangeably with the heat absorber 2 and its heat exchanger element 22.

Figure 2A:
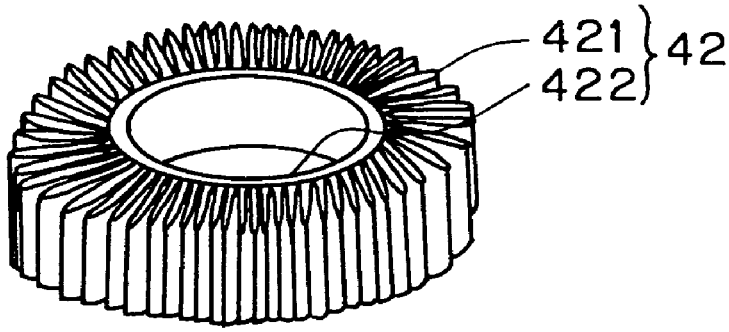
FIG. 2A is an external perspective view of the heat exchanger element of the heat rejector.
Figure 2B:
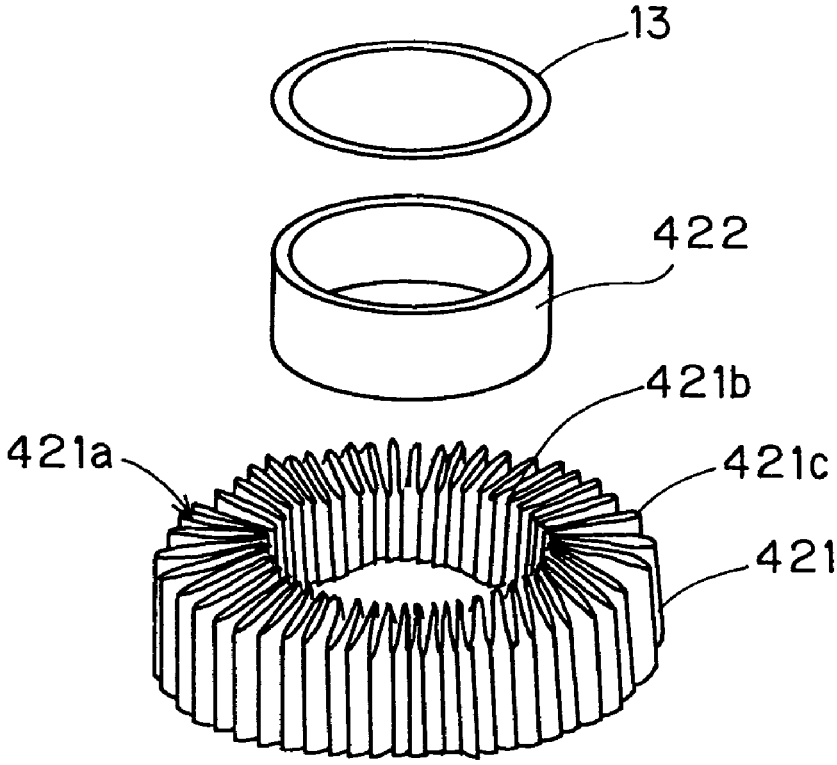
FIG. 2B is an exploded perspective view of the heat exchanger element.
Figure 3:
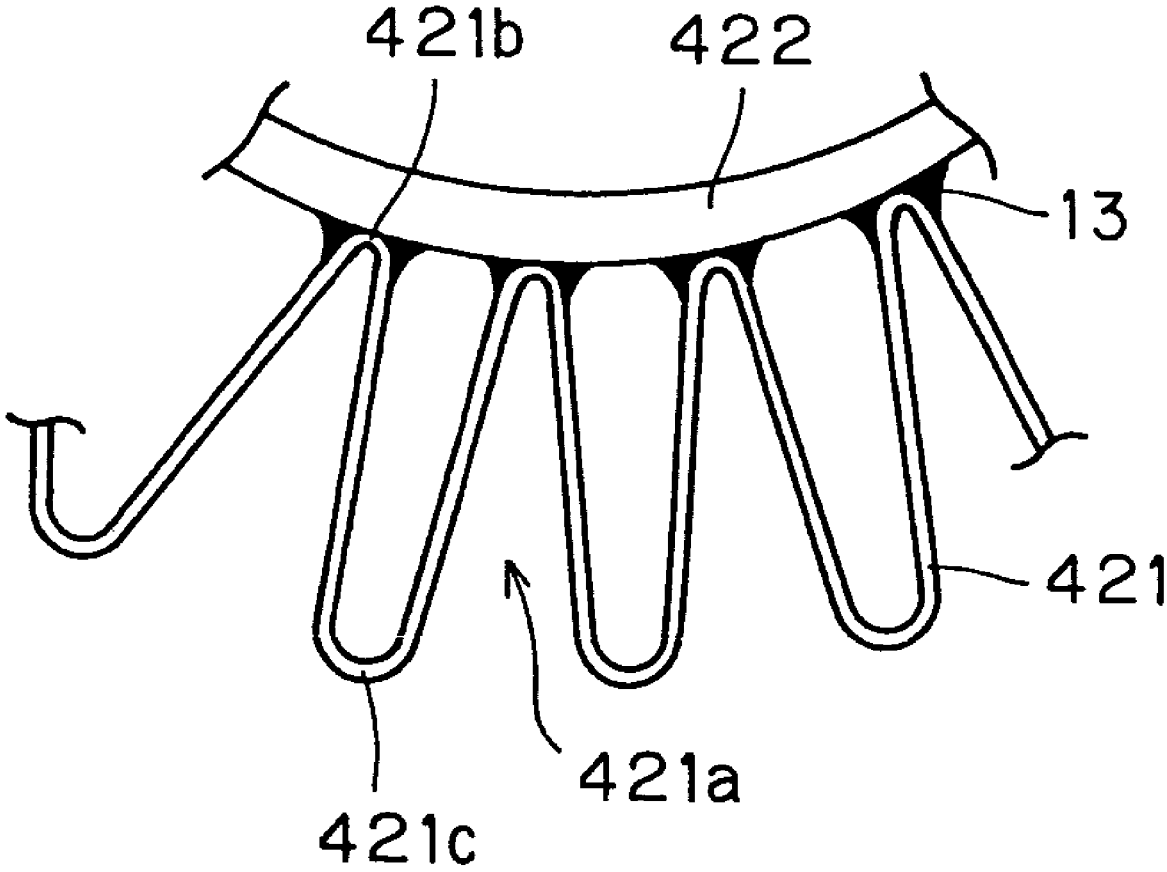
FIG. 3 is an enlarged plan view of a portion of the heat exchanger element, as seen axially.

A first embodiment of the invention will be described below. FIG. 1 is an external perspective view of the heat rejector 4 serving as a heat exchanger member in this embodiment. FIGS. 2A and 2B are an external perspective view and an exploded perspective view, respectively, of the heat exchanger element 42 of the heat rejector 4. FIG. 3 is an enlarged plan view of a portion of the heat rejector, as seen axially.

This heat exchanger element 42 is composed of an annular corrugate fin 421 and an inner ring-shaped member 422. The annular corrugate fin 421 is produced by forming a corrugated sheet material into a cylindrical shape with the individual grooves 421*a* thereof parallel to the axis of the cylindrical shape. The inner ring-shaped member 422 is a cylindrical member made of a material having good thermal conductivity.

Figure 6A:
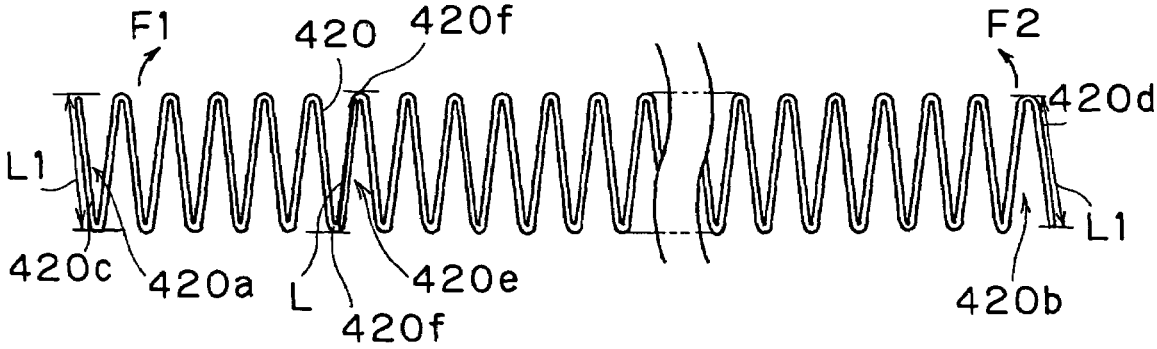
FIG. 6A is a plan view of the linear corrugate fin.
Figure 6B:
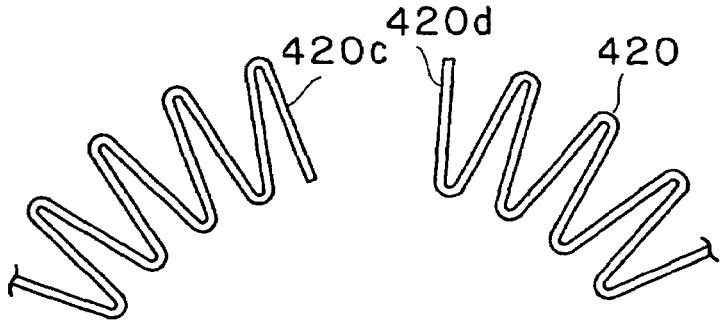
FIG. 6B is an enlarged plan view of the linear corrugate fin in a rounded state with both ends brought close together.
Figure 6C:
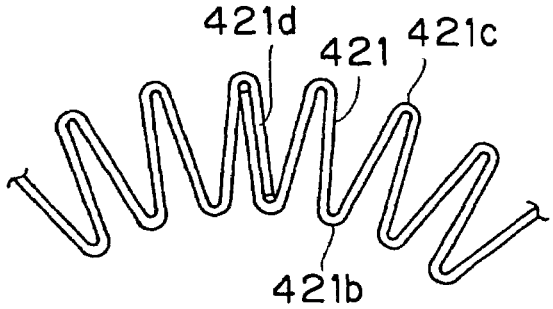
FIG. 6C is an enlarged plan view of a portion of the annular corrugate fin in its finished state.

First, the manufacturing method of the annular corrugate fin 421 used in this embodiment will be described. FIGS. 6A to 6C show the manufacturing procedure of the annular corrugate fin 421. FIG. 6A is a plan view of a linear corrugate fin 420, FIG. 6B is an enlarged plan view of the linear corrugate fin 420 in a rounded state with both ends thereof brought close together, and FIG. 6C is an enlarged plan view of the annular corrugate fin 421 in its finished state.

As FIG. 6A shows, the linear corrugate fin 420 has contiguous grooves 420*e* each having a V-shaped section. At one end of the linear corrugate fin 420 is a V-shaped groove 420*a*, and at the other end thereof is an inverted-V-shaped groove 420*b*. The endmost side 420*c* of the groove 420*a* and the endmost side 420*d* of the groove 420*b* are so formed that their length L1 is shorter than the length L of the slant sides between the tops and bottoms 420*f* and 420*f* of the grooves 420*e* in between.

The linear corrugate fin 420 is bent in the directions indicated by arrows F1 and F2 in FIG. 6A so as to be formed into a cylindrical shape. With the endmost sides 420*c* and 420*d* brought close together as shown in FIG. 6B, those endmost sides 420*c* and 420*d* are hooked on each other as shown in FIG. 6C, and thereby the annular corrugate fin 421 is formed. Thus, as the annular corrugate fin 421 tends to return to its original linear state, the endmost sides 420*c* and 420*d* so hooked on each other pull against each other, and thereby the annular shape of the annular corrugate fin 421 is maintained. Reference numeral 421*d* represents the coupled portion.

Figure 5:
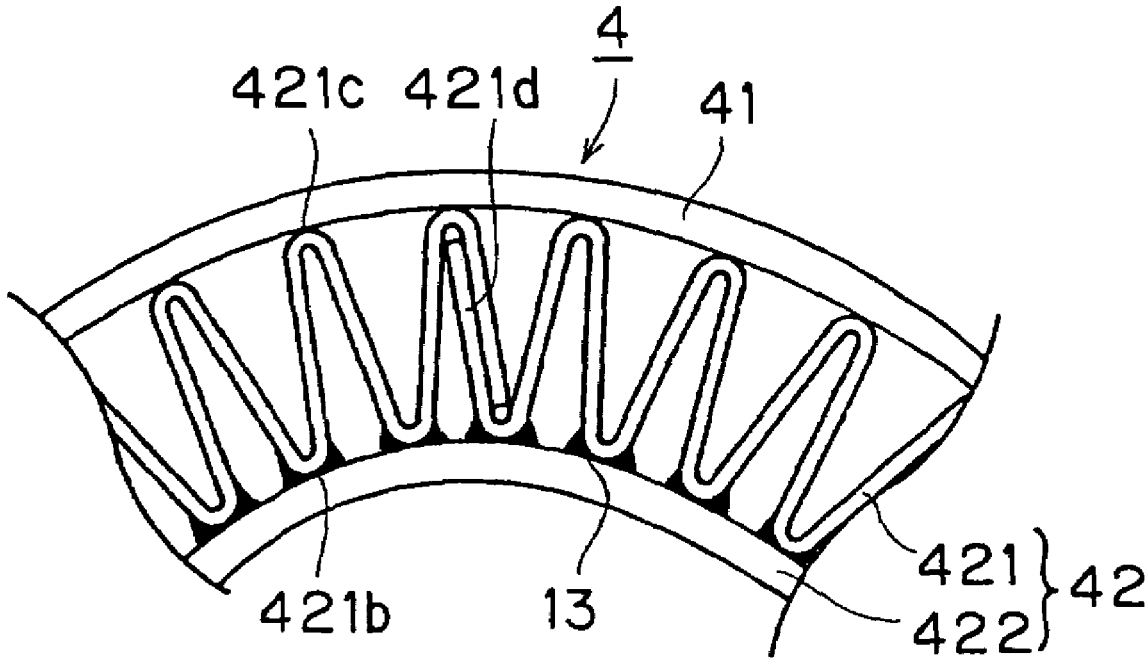
FIG. 5 is an enlarged plan view of a portion of the heat rejector, as seen axially.

As FIGS. 2A and 5 show, the inner ring-shaped member 422 is placed in contact with the inner periphery of the annular corrugate fin 421 so that they are coaxial with each other (i.e., so that their axes coincide with each other). Here, the diameter of the circle formed by smoothly connecting all the bottoms 421*b* of the annular corrugate fin 421 (i.e., the internal diameter of the annular corrugate fin 421) is made substantially equal to the external diameter of the inner ring-shaped member 422.

The annular corrugate fin 421 and the inner ring-shaped member 422 are joined together with a ring-shaped brazing metal 13. Specifically, as FIG. 2B shows, the brazing metal 13 is placed where the annular corrugate fin 421 and the inner ring-shaped member 422 make contact with each other and is heated so that the molten brazing metal 13 flows down along the bottoms 421*b* of the annular corrugate fin 421.

As a result, as FIG. 3 shows, the brazing metal 13 is applied substantially evenly to where the annular corrugate fin 421 and the inner ring-shaped member 422 make contact with each other. When the brazing metal 13 hardens, the annular corrugate fin 421 and the inner ring-shaped member 422 are joined together and thereby integrated together. Instead of brazing specifically mentioned above, soldering or the like may be used.

Figure 4:
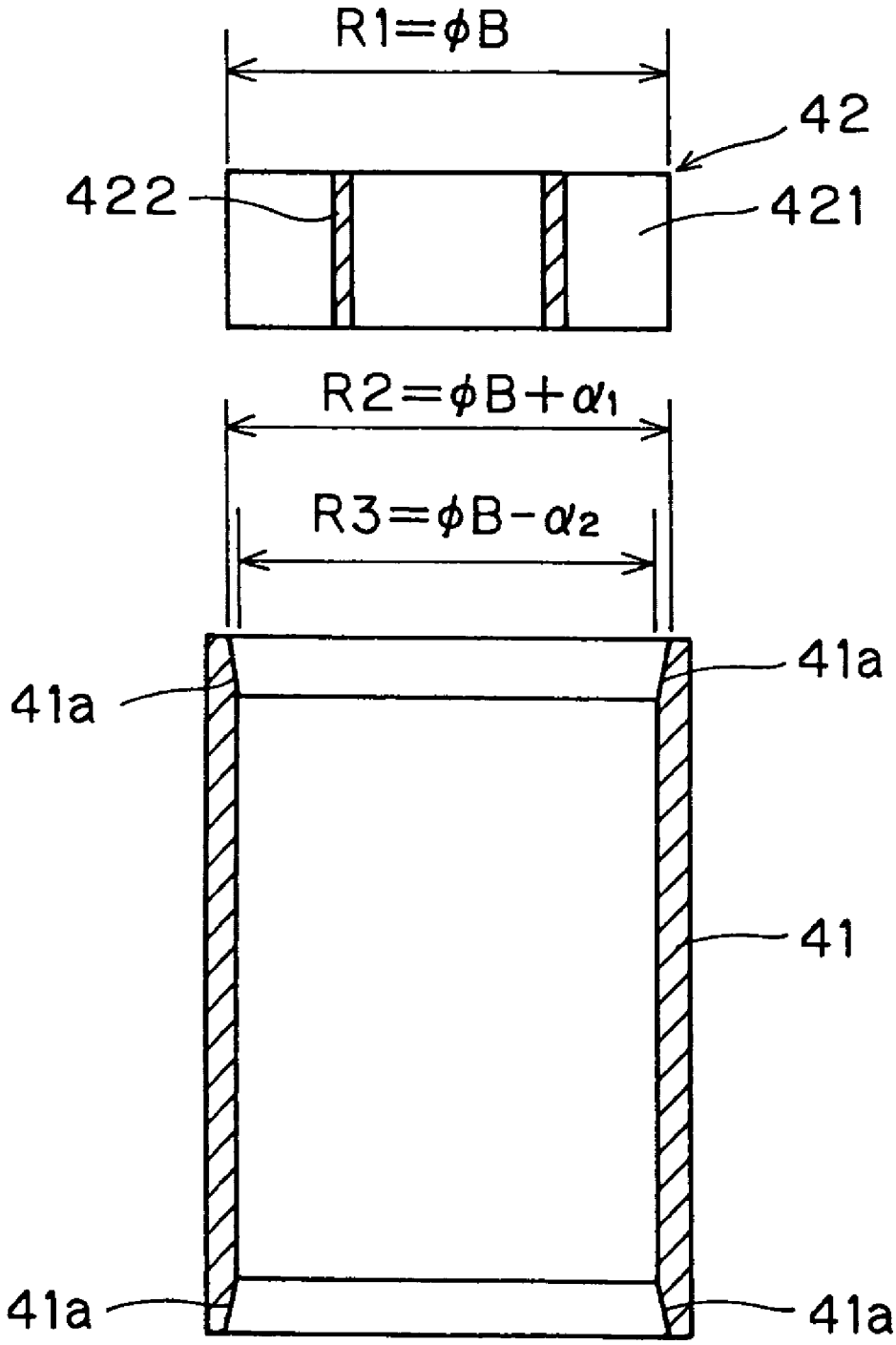
FIG. 4 is a vertical sectional outline of the body and the heat exchanger element of the heat rejector.

The heat exchanger element 42 described above is inserted into a body 41 shown in FIG. 1 so that they are coaxial with each other, and thereby the heat rejector 4 is produced. The heat exchanger element 42 is inserted into the body 41 by the following mechanism. As shown in FIG. 4, which is a sectional outline of the body 41 and the heat exchanger element 42, both ends of the body 41 are tapered so that the wall thickness thereof becomes smaller towards the ends along the axis thereof (these portions are referred to as the tapered portions 41*a*).

Moreover, the external diameter of the heat exchanger element 42 (i.e., the external diameter of the annular corrugate fin 421) R1 ($=\Phi B$) is made slightly smaller than the maximum internal diameter R2 ($=\Phi B+\alpha_1$) of the body 41 at both ends thereof, and slightly greater than the internal diameter R3 ($=\Phi B-\alpha_2$) of the body 41 in the portion thereof between the tapered portions 41*a*.

Thus, when the heat exchanger element 42 is inserted into the heat exchanger element 42 from one end thereof, the insertion requires a small force at first. Since the internal diameter of the body 41 gradually becomes smaller until it eventually becomes smaller than the external diameter R1 of the heat exchanger element 42, as the heat exchanger element 42 is inserted, the force required to do so gradually increases. In this way, the heat exchanger element 42 can be inserted into the body 41 easily.

Here, since the bottoms 421*b* of the annular corrugate fin 421 are fixed to the inner ring-shaped member 422, the annular corrugate fin 421 thus fitted into the body 41, of which the internal diameter R3 is smaller than the external diameter R1 of the annular corrugate fin 421, is brought into a state in which the grooves 421*a* are so pressed as to be wider open, and this produces a resilient force acting radially outward.

Moreover, since the external diameter R1 of the annular corrugate fin 421 and the depth of the grooves 421*a* are constant along the axis, the aforementioned resilient force presses the heat exchanger element 42 onto the inner surface of the body 41 with a uniform force all around and thereby keeps it in position. Here, the annular corrugate fin 421 and the inner ring-shaped member 422 are firmly fixed together, and thus are not deformed.

As described above, in this embodiment, the inner ring-shaped member 422 can be fixed in the desired position inside the body 41 without the use of adhesive or solder. This helps simplify the manufacturing procedure and reduce the manufacturing cost, and also stabilize the heat exchange performance of the heat exchanger member.

Moreover, when the annular corrugate fin 421 is damaged, the heat exchanger element 42 can be taken out of and removed from the body 41. This permits easy replacement as required, and thus helps alleviate the economic burden on the user in the event of repair and solve recycling problems.

Furthermore, in the heat exchanger element 42 used in this embodiment, the annular corrugate fin 421 and the inner ring-shaped member 422 are integrated together by brazing, soldering, or the like, and thus exhibit better thermal conductivity than where they are left unintegrated. This helps increase heat exchange efficiency.

Figure 7:
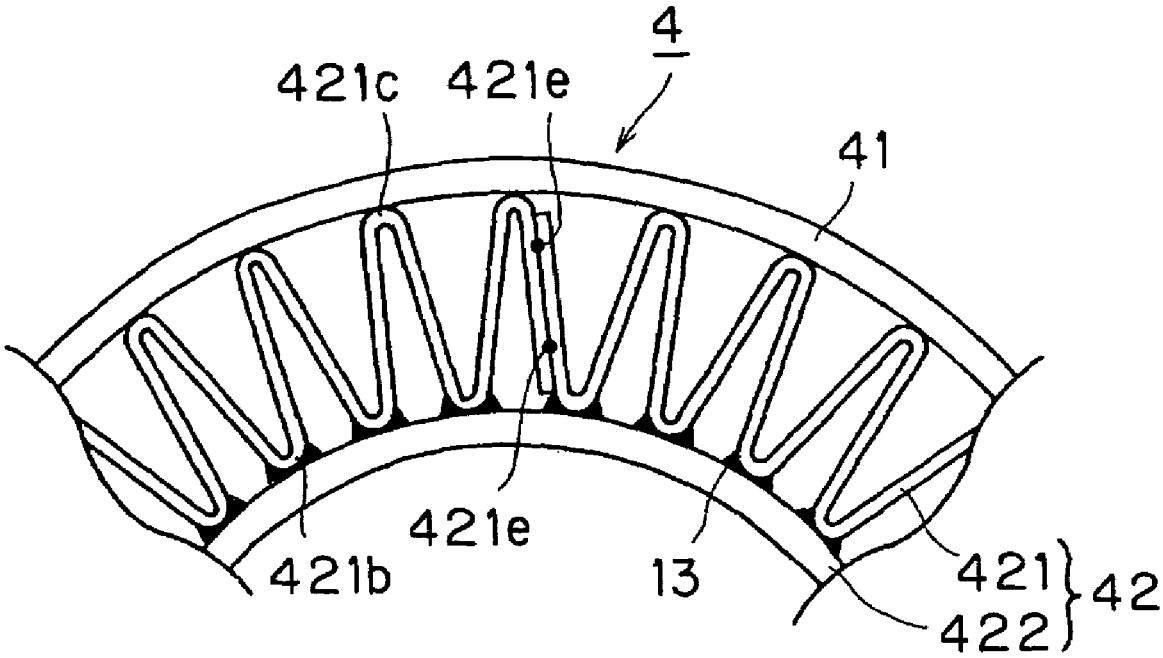
FIG. 7 is an enlarged plan view of a portion of the heat rejector of a second embodiment of the invention, as seen axially.

Next, a second embodiment of the invention will be described. FIG. 7 is an enlarged plan view of the heat rejector 4 of this embodiment, as seen axially. The heat rejector 4 of this embodiment, like that of the first embodiment described above, is composed of a heat exchanger element 42, consisting of an annular corrugate fin 421 and an inner ring-shaped member 422 brazed inside it, and a body 41 into which the heat exchanger element 42 is fitted.

Figure 8A:
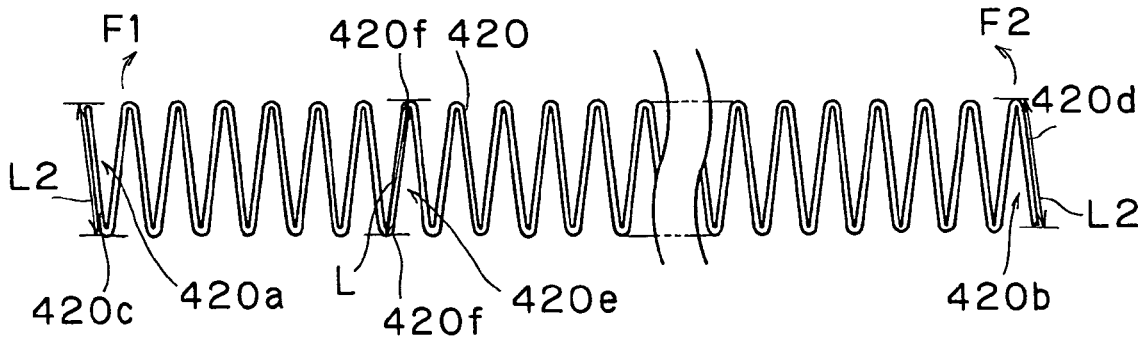
FIG. 8A is a plan view of the linear corrugate fin.
Figure 8B:
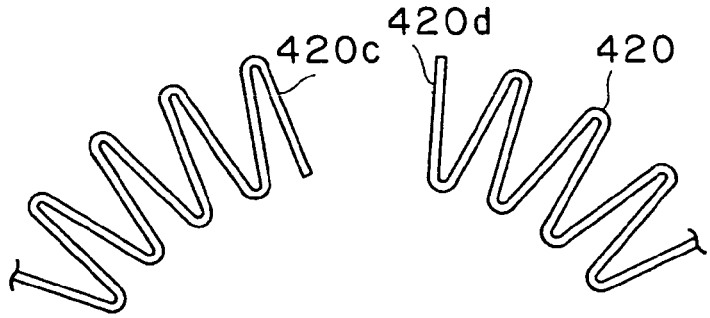
FIG. 8B is an enlarged plan view of the linear corrugate fin in a rounded state with both ends brought close together.
Figure 8C:
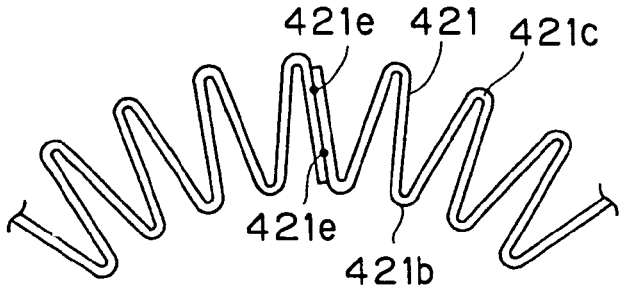
FIG. 8C is an enlarged plan view of a portion of the annular corrugate fin in its finished state.

First, the manufacturing method of the annular corrugate fin 421 used in this embodiment will be described. FIGS. 8A to 8C show the manufacturing procedure of the annular corrugate fin 421. FIG. 8A is a plan view of the linear corrugate fin 420, FIG. 8B is an enlarged plan view of the linear corrugate fin 420 in a rounded state with both ends thereof brought close together, and FIG. 8C is an enlarged plan view of a portion of the annular corrugate fin 421 in its finished state.

As FIG. 8A shows, the linear corrugate fin 420 has contiguous grooves 420*e* each having a V-shaped section. At one end of the linear corrugate fin 420 is a V-shaped groove 420*a*, and at the other end thereof is an inverted-V-shaped groove 420*b*. The endmost side 420*c* of the groove 420*a* and the endmost side 420*d* of the groove 420*b* are so formed that their length L2 is shorter than the length L of the slant sides between the tops and bottoms 420*f* and 420*f* of the grooves 420*e* in between.

The linear corrugate fin 420 is bent in the directions indicated by arrows F1 and F2 in FIG. 8A so as to be formed into a cylindrical shape. With the endmost sides 420*c* and 420*d* brought close together as shown in FIG. 8B, spot welding is performed on parts of the surfaces of those endmost sides 420*c* and 420*d* so that these surfaces are joined together while they are kept in contact with each other. In this way, the annular corrugate fin 421 as shown in FIG. 8C is produced. Reference numeral 421*e* represents the brazed or welded portion.

As FIGS. 2A and 7 show, the inner ring-shaped member 422 is placed in contact with the inner periphery of the annular corrugate fin 421 so that they are coaxial with each other. Here, the diameter of the circle formed by smoothly connecting all the bottoms 421*b* of the annular corrugate fin 421 (i.e., the internal diameter of the annular corrugate fin 421) is made substantially equal to the external diameter of the inner ring-shaped member 422.

The annular corrugate fin 421 and the inner ring-shaped member 422 are joined together with a ring-shaped brazing metal 13. Specifically, as FIG. 2B shows, the brazing metal 13 is placed where the annular corrugate fin 421 and the inner ring-shaped member 422 make contact with each other and is heated so that the molten brazing metal 13 flows down along the bottoms 421*b* of the annular corrugate fin 421.

As a result, as FIG. 3 shows, the brazing metal 13 is applied substantially evenly to where the annular corrugate fin 421 and the inner ring-shaped member 422 make contact with each other. When the brazing metal 13 hardens, the annular corrugate fin 421 and the inner ring-shaped member 422 are joined together and thereby integrated together. Instead of brazing specifically mentioned above, soldering or the like may be used.

The heat exchanger element 42 described above is inserted into a body 41 shown in FIG. 1 so that they are coaxial with each other, and thereby the heat rejector 4 is produced. The heat exchanger element 42 is inserted into the body 41 by the following mechanism. As shown in FIG. 4, which is a sectional outline of the body 41 and the heat exchanger element 42, both ends of the body 41 are tapered so that the wall thickness thereof becomes smaller towards the ends along the axis thereof (these portions are referred to as the tapered portions 41*a*).

Moreover, the external diameter of the heat exchanger element 42 (i.e. the external diameter of the annular corrugate fin 421) R1 ($=\phi B$) is made slightly smaller than the maximum internal diameter R2 ($=\phi B+\alpha_1$) of the body 41 at both ends thereof, and slightly greater than the internal diameter R3 ($=\phi B-\alpha_2$) of the body 41 in the portion thereof between the tapered portions 41*a*.

Thus, when the heat exchanger element 42 is inserted into the heat exchanger element 42 from one end thereof, the insertion requires a small force at first. Since the internal diameter of the body 41 gradually becomes smaller until it eventually becomes smaller than the external diameter R1 of the heat exchanger element 42, as the heat exchanger element 42 is inserted, the force required to do so gradually increases. In this way, the heat exchanger element 42 can be inserted into the body 41 easily.

Here, since the bottoms 421*b* of the annular corrugate fin 421 are fixed to the inner ring-shaped member 422, the annular corrugate fin 421 thus fitted into the body 41, of which the internal diameter R3 is smaller than the external diameter R1 of the annular corrugate fin 421, is brought into a state in which the grooves 421*a* are so pressed as to be wider open, and this produces a resilient force acting radially outward.

Moreover, since the external diameter R1 of the annular corrugate fin 421 and the depth of the grooves 421*a* are constant along the axis, the aforementioned resilient force presses the heat exchanger element 42 onto the inner surface of the body 41 with a uniform force all around and thereby keeps it in position. Here, the annular corrugate fin 421 and the inner ring-shaped member 422 are firmly fixed together, and thus are not deformed.

As described above, in this embodiment, the inner ring-shaped member 422 can be fixed in the desired position inside the body 41 without the use of adhesive or solder. This helps simplify the manufacturing procedure and reduce the manufacturing cost, and also stabilize the heat exchange performance of the heat exchanger member.

Moreover, when the annular corrugate fin 421 is damaged, the heat exchanger element 42 can be taken out of and removed from the body 41. This permits easy replacement as required, and thus helps alleviate the economic burden on the user in the event of repair and solve recycling problems.

Furthermore, in the heat exchanger element 42 used in this embodiment, the annular corrugate fin 421 and the inner ring-shaped member 422 are integrated together by brazing, soldering, or the like, and thus exhibit better thermal conductivity than where they are left unintegrated. This helps increase heat exchange efficiency.

Figure 9:
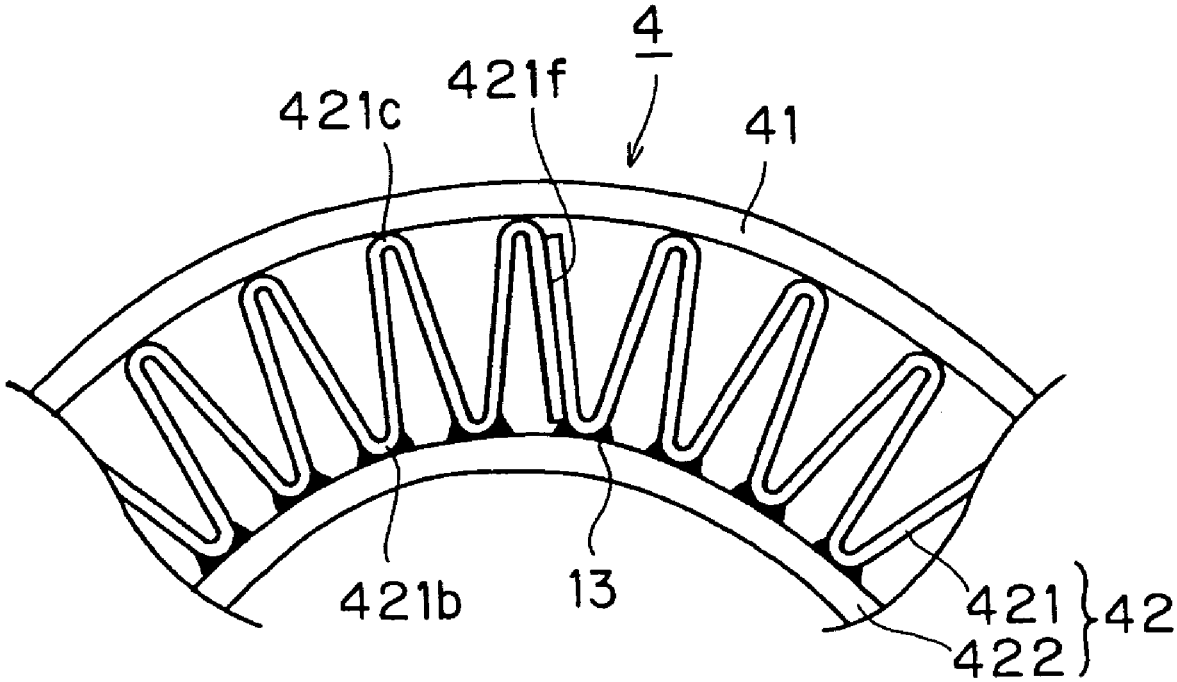
FIG. 9 is an enlarged plan view of a portion of the heat rejector of a third embodiment of the invention, as seen axially.

Next, a third embodiment of the invention will be described. FIG. 9 is a plan view of a portion of the heat rejector 4 of this embodiment, as seen axially. The heat rejector 4 of this embodiment, like that of the first embodiment described earlier, is composed of a heat exchanger element 42, consisting of an annular corrugate fin 421 and an inner ring-shaped member 422 brazed inside it, and a body 41 into which the heat exchanger element 42 is fitted.

First, the manufacturing method of the annular corrugate fin 421 used in this embodiment will be described. FIGS.

Figure 10A:
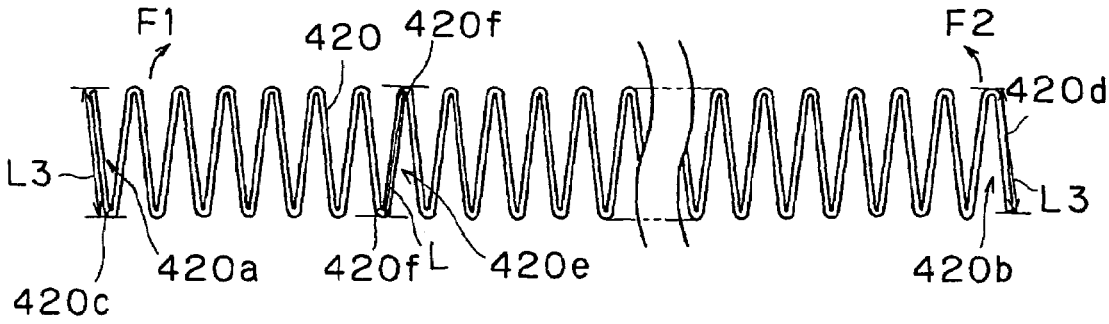
FIG. 10A is a plan view of the linear corrugate fin.

10A and 10B show the manufacturing procedure of the annular corrugate fin 421. FIG. 10A is a plan view of the linear corrugate fin 420, FIG. 10B is an enlarged plan view of the linear corrugate fin 420 in a rounded state with both ends thereof brought close together, and FIG. 10C is an enlarged plan view of a portion of the annular corrugate fin 421 in its finished state.

As FIG. 10A shows, the linear corrugate fin 420 has contiguous grooves 420*e* each having a V-shaped section. At one end of the linear corrugate fin 420 is a V-shaped groove 420*a*, and at the other end thereof is an inverted-V-shaped groove 420*b*. The endmost side 420*c* of the groove 420*a* and the endmost side 420*d* of the groove 420*b* are so formed that their length L3 is shorter than the length L of the slant sides between the tops and bottoms 420*f* and 420*f* of the grooves 420*e* in between.

Figure 10B:
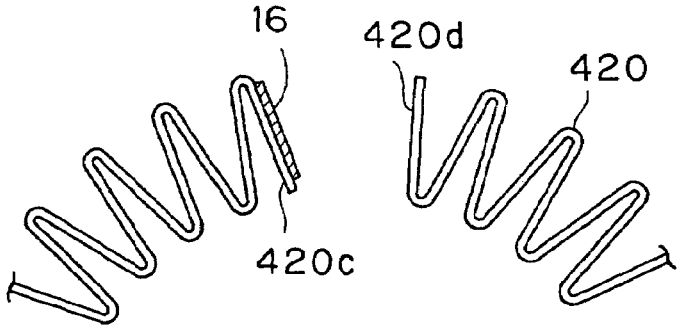
FIG. 10B is an enlarged plan view of the linear corrugate fin in a rounded state with both ends brought close together.
Figure 10C:
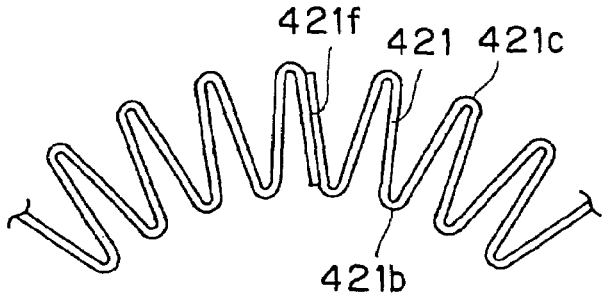
FIG. 10C is an enlarged plan view of a portion of the annular corrugate fin in its finished state.

The linear corrugate fin 420 is bent in the directions indicated by arrows F1 and F2 in FIG. 10A so as to be formed into a cylindrical shape so that the endmost sides 420*c* and 420*d* are put together (FIG. 10B). Then, the surfaces of those endmost sides 420*c* and 420*d*, to which adhesive 16 such as instant adhesive has been applied beforehand, are held in contact with each other for a while so that they are bonded together. In this way, the annular corrugate fin 421 as shown in FIG. 10C is produced. Reference numeral 421*f* represents the bonded portion.

As FIGS. 2A and 9 show, the inner ring-shaped member 422 is placed in contact with the inner periphery of the annular corrugate fin 421 so that they are coaxial with each other. Here, the diameter of the circle formed by smoothly connecting all the bottoms 421*b* of the annular corrugate fin 421 (i.e. the internal diameter of the annular corrugate fin 421) is made substantially equal to the external diameter of the inner ring-shaped member 422.

The annular corrugate fin 421 and the inner ring-shaped member 422 are joined together with a ring-shaped brazing metal 13. Specifically, as FIG. 2B shows, the brazing metal 13 is placed where the annular corrugate fin 421 and the inner ring-shaped member 422 make contact with each other and is heated so that the molten brazing metal 13 flows down along the bottoms 421*b* of the annular corrugate fin 421.

As a result, as FIG. 3 shows, the brazing metal 13 is applied substantially evenly to where the annular corrugate fin 421 and the inner ring-shaped member 422 make contact with each other. When the brazing metal 13 hardens, the annular corrugate fin 421 and the inner ring-shaped member 422 are joined together and thereby integrated together. Instead of brazing specifically mentioned above, soldering or the like may be used.

The heat exchanger element 42 described above is inserted into a body 41 shown in FIG. 1 so that they are coaxial with each other, and thereby the heat rejector 4 is produced. The heat exchanger element 42 is inserted into the body 41 by the following mechanism. As shown in FIG. 4, which is a sectional outline of the body 41 and the heat exchanger element 42, both ends of the body 41 are tapered so that the wall thickness thereof becomes smaller towards the ends along the axis thereof (these portions are referred to as the tapered portions 41*a*).

Moreover, the external diameter of the heat exchanger element 42 (i.e., the external diameter of the annular corrugate fin 421) R1 (=ΦB) is made slightly smaller than the maximum internal diameter R2 ($=\Phi B+\alpha_1$) of the body 41 at both ends thereof, and slightly greater than the internal diameter R3 ($=\Phi B-\alpha_2$) of the body 41 in the portion thereof between the tapered portions 41*a*.

Thus, when the heat exchanger element 42 is inserted into the heat exchanger element 42 from one end thereof, the insertion requires a small force at first. Since the internal diameter of the body 41 gradually becomes smaller until it eventually becomes smaller than the external diameter R1 of the heat exchanger element 42, as the heat exchanger element 42 is inserted, the force required to do so gradually increases. In this way, the heat exchanger element 42 can be inserted into the body 41 easily.

Here, since the bottoms 421*b* of the annular corrugate fin 421 are fixed to the inner ring-shaped member 422, the annular corrugate fin 421 thus fitted into the body 41, of which the internal diameter R3 is smaller than the external diameter R1 of the annular corrugate fin 421, is brought into a state in which the grooves 421*a* are so pressed as to be wider open, and this produces a resilient force acting radially outward.

Moreover, since the external diameter R1 of the annular corrugate fin 421 and the depth of the grooves 421*a* are constant along the axis, the aforementioned resilient force presses the heat exchanger element 42 onto the inner surface of the body 41 with a uniform force all around and thereby keeps it in position. Here, the annular corrugate fin 421 and the inner ring-shaped member 422 are firmly fixed together, and thus are not deformed.

As described above, in this embodiment, the inner ring-shaped member 422 can be fixed in the desired position inside the body 41 without the use of adhesive or solder. This helps simplify the manufacturing procedure and reduce the manufacturing cost, and also stabilize the heat exchange performance of the heat exchanger member.

Moreover, when the annular corrugate fin 421 is damaged, the heat exchanger element 42 can be taken out of and removed from the body 41. This permits easy replacement as required, and thus helps alleviate the economic burden on the user in the event of repair and solve recycling problems.

Furthermore, in the heat exchanger element 42 used in this embodiment, the annular corrugate fin 421 and the inner ring-shaped member 422 are integrated together by brazing, soldering, or the like, and thus exhibit better thermal conductivity than where they are left unintegrated. This helps increase heat exchange efficiency.

Figure 11:
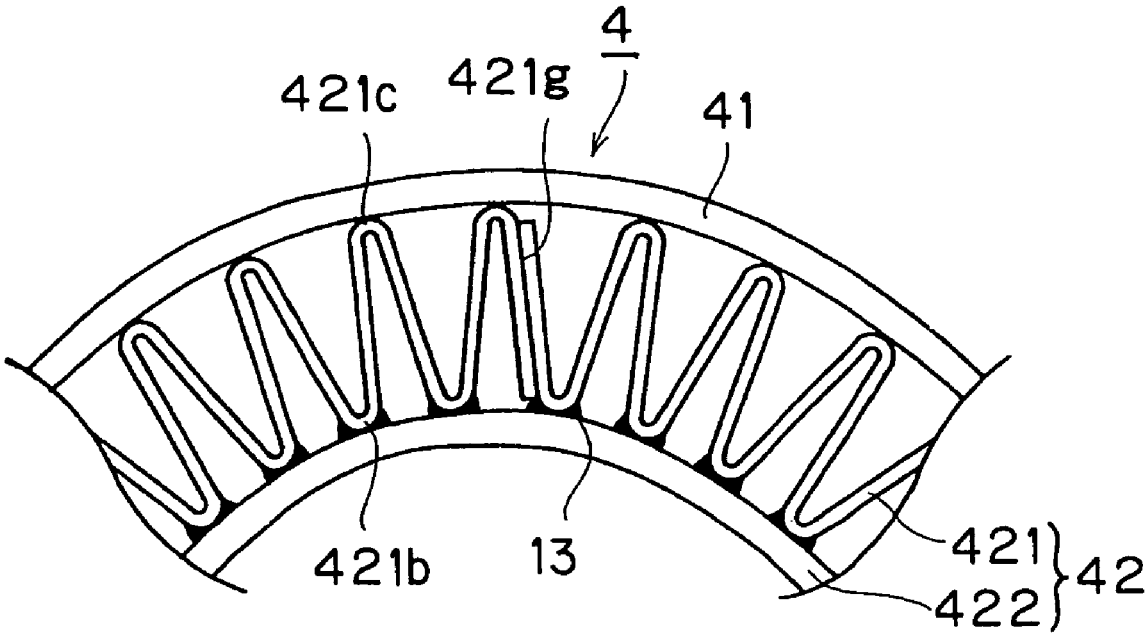
FIG. 11 is an enlarged plan view of the heat rejector of a fourth embodiment of the invention, as seen axially.

Next, a fourth embodiment of the invention will be described. FIG. 11 is a plan view of a portion of the heat rejector 4 of this embodiment, as seen axially. The heat rejector 4 of this embodiment, like that of the first embodiment described earlier, is composed of a heat exchanger element 42, consisting of an annular corrugate fin 421 and an inner ring-shaped member 422 brazed inside it, and a body 41 into which the heat exchanger element 42 is fitted.

Figure 12A:
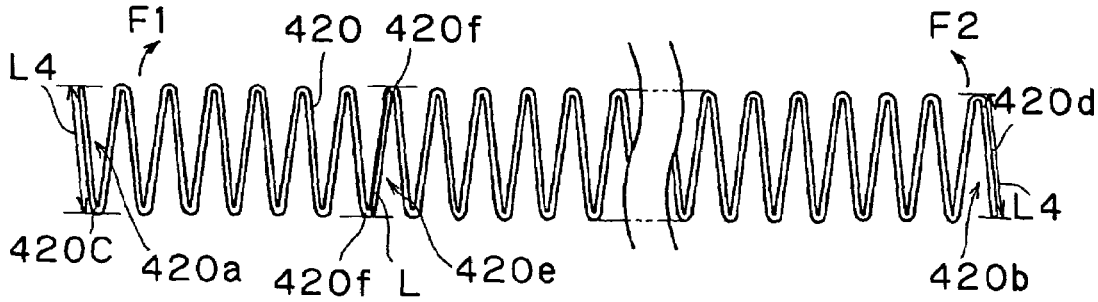
FIG. 12A is a plan view of the linear corrugate fin.
Figure 12B:
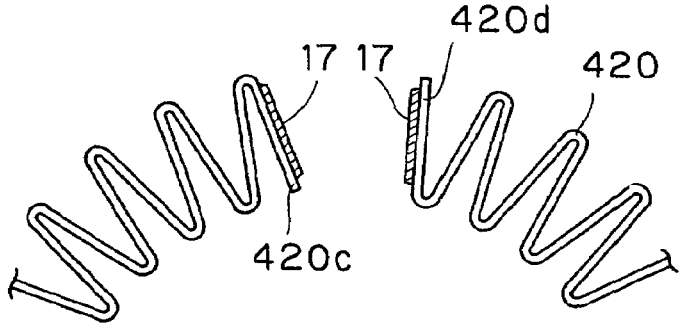
FIG. 12B is an enlarged plan view of the linear corrugate fin in a rounded state with both ends brought close together.
Figure 12C:
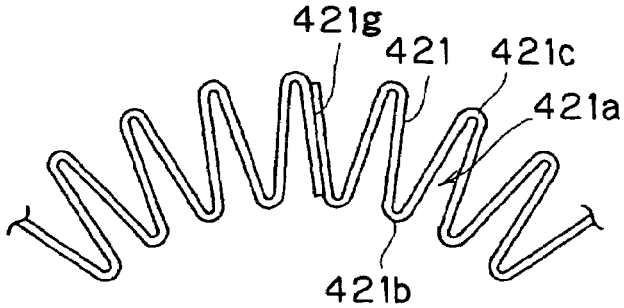
FIG. 12C is an enlarged plan view of a portion of the annular corrugate fin in its finished state.

First, the manufacturing method of the annular corrugate fin 421 used in this embodiment will be described. FIGS. 12A to 12C show the manufacturing procedure of the annular corrugate fin 421. FIG. 12A is a plan view of the linear corrugate fin 420, FIG. 12B is an enlarged plan view of the linear corrugate fin 420 in a rounded state with both ends thereof brought close together, and FIG. 12C is an enlarged plan view of a portion of the annular corrugate fin 421 in its finished state.

As FIG. 12A shows, the linear corrugate fin 420 has contiguous grooves 420*e* each having a V-shaped section. At one end of the linear corrugate fin 420 is a V-shaped groove 420*a*, and at the other end thereof is an inverted-V-shaped groove 420*b*. The endmost side 420*c* of the groove 420*a* and the endmost side 420*d* of the groove 420*b* are so formed that their length L4 is shorter than the length L of the slant sides between the tops and bottoms 420*f* and 420*f* of the grooves 420*e* in between.

The linear corrugate fin 420 is bent in the directions indicated by arrows F1 and F2 in FIG. 12A so as to be formed into a cylindrical shape so that the endmost sides 420*c* and 420*d* are put together (FIG. 12B). Then, the surfaces of those endmost sides 420*c* and 420*d*, to which solder 17 in the form of paste has been applied uniformly beforehand, are held in contact with each other and heated for a while so that they are soldered together. In this way, the annular corrugate fin 421 as shown in FIG. 12C is produced. Reference numeral 421*g* represents the soldered or welded portion.

As FIGS. 2A and 11 show, the inner ring-shaped member 422 is placed in contact with the inner periphery of the annular corrugate fin 421 so that they are coaxial with each other. Here, the diameter of the circle formed by smoothly connecting all the bottoms 421*b* of the annular corrugate fin 421 (i.e. the internal diameter of the annular corrugate fin 421) is made substantially equal to the external diameter of the inner ring-shaped member 422.

The annular corrugate fin 421 and the inner ring-shaped member 422 are joined together with a ring-shaped brazing metal 13. Specifically, as FIG. 2B shows, the brazing metal 13 is placed where the annular corrugate fin 421 and the inner ring-shaped member 422 make contact with each other and is heated so that the molten brazing metal 13 flows down along the bottoms 421*b* of the annular corrugate fin 421.

As a result, as FIG. 3 shows, the brazing metal 13 is applied substantially evenly to where the annular corrugate fin 421 and the inner ring-shaped member 422 make contact with each other. When the brazing metal 13 hardens, the annular corrugate fin 421 and the inner ring-shaped member 422 are joined together and thereby integrated together. Instead of brazing specifically mentioned above, soldering or the like may be used.

The heat exchanger element 42 described above is inserted into a body 41 shown in FIG. 1 so that they are coaxial with each other, and thereby the heat rejector 4 is produced. The heat exchanger element 42 is inserted into the body 41 by the following mechanism. As shown in FIG. 4, which is a sectional outline of the body 41 and the heat exchanger element 42, both ends of the body 41 are tapered so that the wall thickness thereof becomes smaller towards the ends along the axis thereof (these portions are referred to as the tapered portions 41*a*).

Moreover, the external diameter of the heat exchanger element 42 (i.e., the external diameter of the annular corrugate fin 421) R1 (=ΦB) is made slightly smaller than the maximum internal diameter R2 ($=\Phi B+\alpha_1$) of the body 41 at both ends thereof, and slightly greater than the internal diameter R3 ($=\Phi B-\alpha_2$) of the body 41 in the portion thereof between the tapered portions 41*a*.

Thus, when the heat exchanger element 42 is inserted into the heat exchanger element 42 from one end thereof, the insertion requires a small force at first. Since the internal diameter of the body 41 gradually becomes smaller until it eventually becomes smaller than the external diameter R1 of the heat exchanger element 42, as the heat exchanger element 42 is inserted, the force required to do so gradually increases. In this way, the heat exchanger element 42 can be inserted into the body 41 easily.

Here, since the bottoms 421*b* of the annular corrugate fin 421 are fixed to the inner ring-shaped member 422, the annular corrugate fin 421 thus fitted into the body 41, of which the internal diameter R3 is smaller than the external diameter R1 of the annular corrugate fin 421, is brought into a state in which the grooves 421*a* are so pressed as to be wider open, and this produces a resilient force acting radially outward.

Moreover, since the external diameter R1 of the annular corrugate fin 421 and the depth of the grooves 421*a* are constant along the axis, the aforementioned resilient force presses the heat exchanger element 42 onto the inner surface of the body 41 with a uniform force all around and thereby keeps it in position. Here, the annular corrugate fin 421 and the inner ring-shaped member 422 are firmly fixed together, and thus are not deformed.

As described above, in this embodiment, the inner ring-shaped member 422 can be fixed in the desired position inside the body 41 without the use of adhesive or solder. This helps simplify the manufacturing procedure and reduce the manufacturing cost, and also stabilize the heat exchange performance of the heat exchanger member.

Moreover, when the annular corrugate fin 421 is damaged, the heat exchanger element 42 can be taken out of and removed from the body 41. This permits easy replacement as required, and thus helps alleviate the economic burden on the user in the event of repair and solve recycling problems.

Furthermore, in the heat exchanger element 42 used in this embodiment, the annular corrugate fin 421 and the inner ring-shaped member 422 are integrated together by brazing, soldering, or the like, and thus exhibit better thermal conductivity than where they are left unintegrated. This helps increase heat exchange efficiency.

Figure 13:
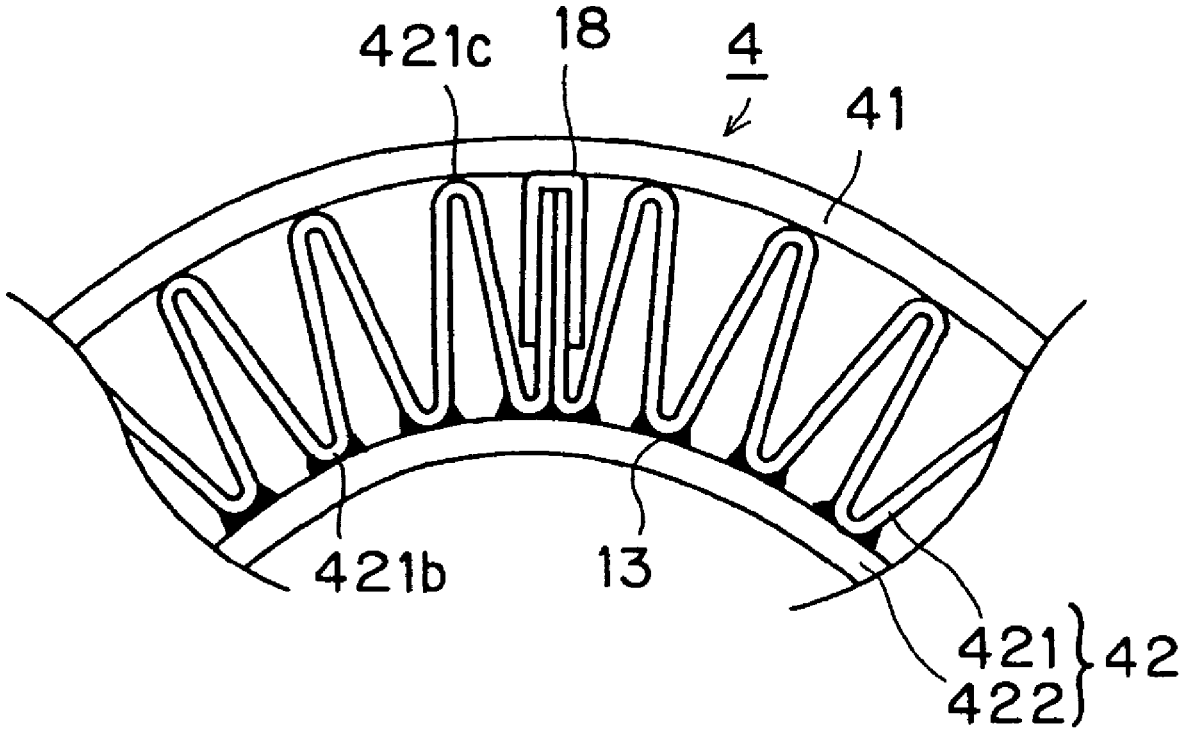
FIG. 13 is an enlarged plan view of a portion of the heat rejector of a fifth embodiment of the invention, as seen axially.

Next, a fifth embodiment of the invention will be described. FIG. 13 is a plan view of a portion of the heat rejector 4 of this embodiment, as seen axially. The heat rejector 4 of this embodiment, like that of the first embodiment described earlier, is composed of a heat exchanger element 42, consisting of an annular corrugate fin 421 and an inner ring-shaped member 422 brazed inside it, and a body 41 into which the heat exchanger element 42 is fitted.

Figure 14A:
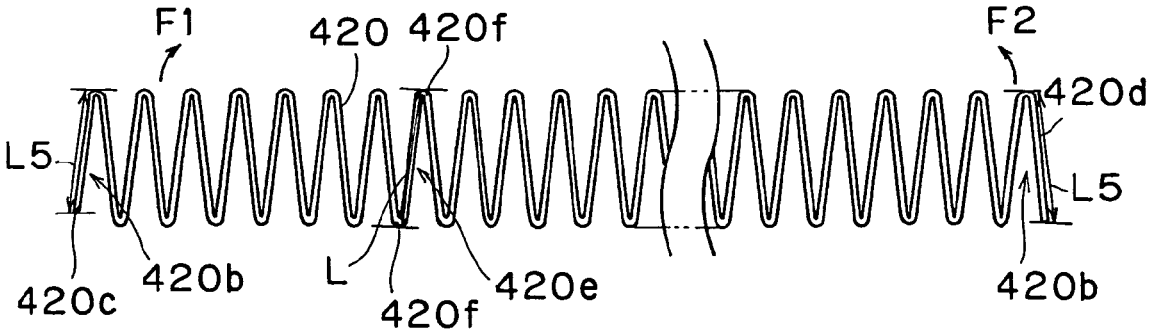
FIG. 14A is a plan view of the linear corrugate fin.
Figure 14B:
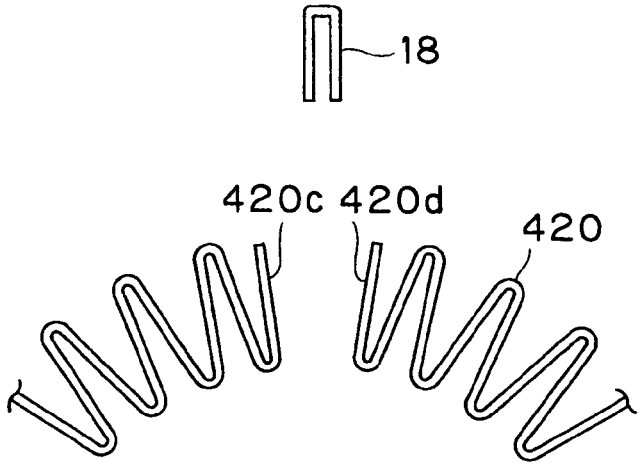
FIG. 14B is an enlarged plan view of the linear corrugate fin in a rounded state with both ends brought close together.
Figure 14C:
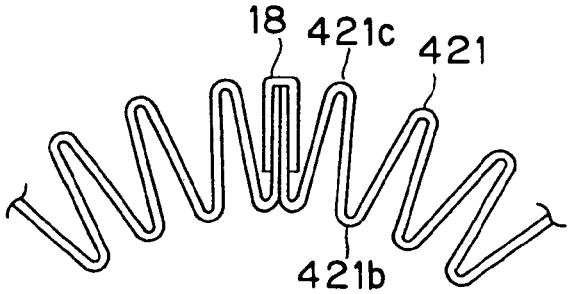
FIG. 14C is an enlarged plan view of a portion of the annular corrugate fin in its finished state.

First, the manufacturing method of the annular corrugate fin 421 used in this embodiment will be described. FIGS. 14A to 14C show the manufacturing procedure of the annular corrugate fin 421. FIG. 14A is a plan view of the linear corrugate fin 420, FIG. 14B is an enlarged plan view of the linear corrugate fin 420 in a rounded state with both ends thereof brought close together, and FIG. 14C is an enlarged plan view of a portion of the annular corrugate fin 421 in its finished state.

As FIG. 14A shows, the linear corrugate fin 420 has contiguous grooves 420*e* each having a V-shaped section. At both ends of the linear corrugate fin 420 are inverted-V-shaped grooves 420*b*. The endmost side 420*c* of the groove 420*a* and the endmost side 420*d* of the groove 420*b* are so formed that their length L5 is shorter than the length L of the slant sides between the tops and bottoms 420*f* and 420*f* of the grooves 420*e* in between.

The linear corrugate fin 420 is bent in the directions indicated by arrows F1 and F2 in FIG. 14A so as to be formed into a cylindrical shape so that the endmost sides 420*c* and 420*d* are put together (FIG. 14B). Then, the endmost sides 420*c* and 420*d* are, with the surfaces thereof held in contact with each other over their entire surfaces, coupled together with a coupling member 18 made of a highly resilient material and having a C-shaped section. In this way, the annular corrugate fin 421 as shown in FIG. 14C is produced.

As FIGS. 2A and 13 show, the inner ring-shaped member 422 is placed in contact with the inner periphery of the annular corrugate fin 421 so that they are coaxial with each other. Here, the diameter of the circle formed by smoothly connecting all the bottoms 421*b* of the annular corrugate fin 421 (i.e., the internal diameter of the annular corrugate fin 421) is made substantially equal to the external diameter of the inner ring-shaped member 422.

The annular corrugate fin 421 and the inner ring-shaped member 422 are joined together with a ring-shaped brazing metal 13. Specifically, as FIG. 2B shows, the brazing metal 13 is placed where the annular corrugate fin 421 and the inner ring-shaped member 422 make contact with each other and is heated so that the molten brazing metal 13 flows down along the bottoms 421*b* of the annular corrugate fin 421.

As a result, as FIG. 3 shows, the brazing metal 13 is applied substantially evenly to where the annular corrugate fin 421 and the inner ring-shaped member 422 make contact with each other. When the brazing metal 13 hardens, the annular corrugate fin 421 and the inner ring-shaped member 422 are joined together and thereby integrated together. Instead of brazing specifically mentioned above, soldering or the like may be used.

The heat exchanger element 42 described above is inserted into a body 41 shown in FIG. 1 so that they are coaxial with each other, and thereby the heat rejector 4 is produced. The heat exchanger element 42 is inserted into the body 41 by the following mechanism. As shown in FIG. 4, which is a sectional outline of the body 41 and the heat exchanger element 42, both ends of the body 41 are tapered so that the wall thickness thereof becomes smaller towards the ends along the axis thereof (these portions are referred to as the tapered portions 41*a*).

Moreover, the external diameter of the heat exchanger element 42 (i.e. the external diameter of the annular corrugate fin 421) R1 ($=\phi B$) is made slightly smaller than the maximum internal diameter R2 ($=\phi B+\alpha_1$) of the body 41 at both ends thereof, and slightly greater than the internal diameter R3 ($=\phi B-\alpha_2$) of the body 41 in the portion thereof between the tapered portions 41*a*.

Thus, when the heat exchanger element 42 is inserted into the heat exchanger element 42 from one end thereof, the insertion requires a small force at first. Since the internal diameter of the body 41 gradually becomes smaller until it eventually becomes smaller than the external diameter R1 of the heat exchanger element 42, as the heat exchanger element 42 is inserted, the force required to do so gradually increases. In this way, the heat exchanger element 42 can be inserted into the body 41 easily.

Here, since the bottoms 421*b* of the annular corrugate fin 421 are fixed to the inner ring-shaped member 422, the annular corrugate fin 421 thus fitted into the body 41, of which the internal diameter R3 is smaller than the external diameter R1 of the annular corrugate fin 421, is brought into a state in which the grooves 421*a* are so pressed as to be wider open, and this produces a resilient force acting radially outward.

Moreover, since the external diameter R1 of the annular corrugate fin 421 and the depth of the grooves 421*a* are constant along the axis, the aforementioned resilient force presses the heat exchanger element 42 onto the inner surface of the body 41 with a uniform force all around and thereby keeps it in position. Here, the annular corrugate fin 421 and the inner ring-shaped member 422 are firmly fixed together, and thus are not deformed.

As described above, in this embodiment, the inner ring-shaped member 422 can be fixed in the desired position inside the body 41 without the use of adhesive or solder. This helps simplify the manufacturing procedure and reduce the manufacturing cost, and also stabilize the heat exchange performance of the heat exchanger member.

Moreover, when the annular corrugate fin 421 is damaged, the heat exchanger element 42 can be taken out of and removed from the body 41. This permits easy replacement as required, and thus helps alleviate the economic burden on the user in the event of repair and solve recycling problems.

Furthermore, in the heat exchanger element 42 used in this embodiment, the annular corrugate fin 421 and the inner ring-shaped member 422 are integrated together by brazing, soldering, or the like, and thus exhibit better thermal conductivity than where they are left unintegrated. This helps increase heat exchange efficiency.

Figure 15:
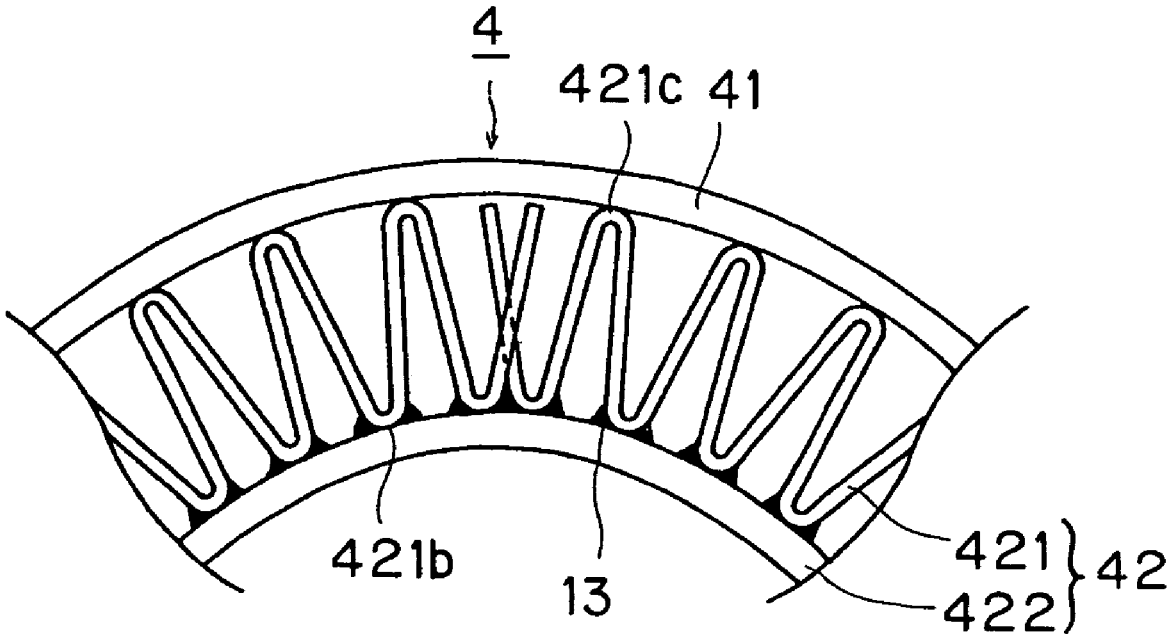
FIG. 15 is an enlarged plan view of a portion of the heat rejector of a sixth embodiment of the invention, as seen axially.

Next, a sixth embodiment of the invention will be described. FIG. 15 is a plan view of a portion of the heat rejector 4 of this embodiment, as seen axially. The heat rejector 4 of this embodiment, like that of the first embodiment described earlier, is composed of a heat exchanger element 42, consisting of an annular corrugate fin 421 and an inner ring-shaped member 422 brazed inside it, and a body 41 into which the heat exchanger element 42 is fitted.

Figure 16A:
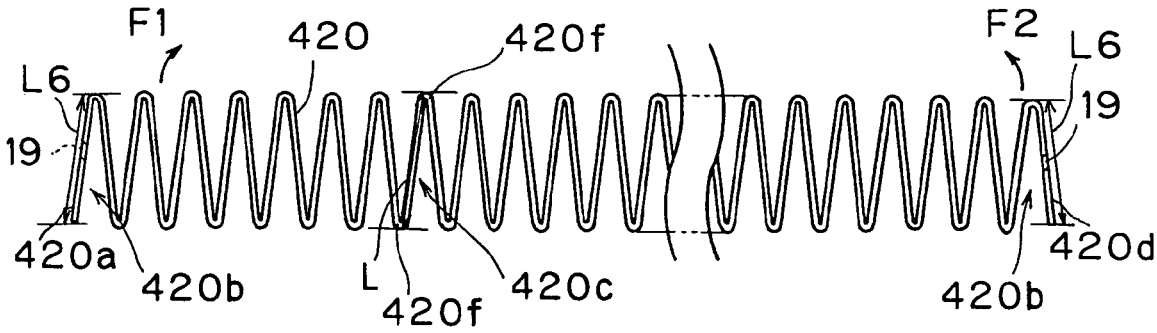
FIG. 16A is a plan view of the linear corrugate fin.
Figure 16B:
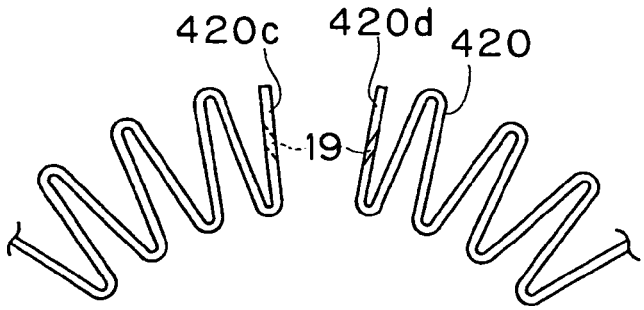
FIG. 16B is an enlarged plan view of the linear corrugate fin in a rounded state with both ends brought close together.
Figure 16C:
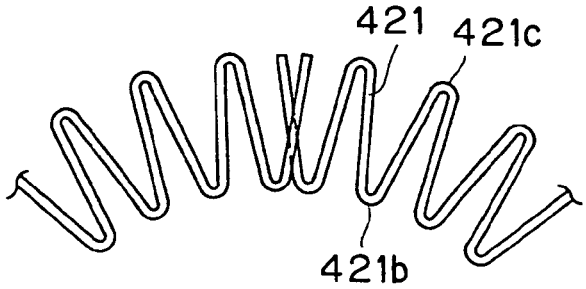
FIG. 16C is an enlarged plan view of a portion of the annular corrugate fin in its finished state.
Figure 17:
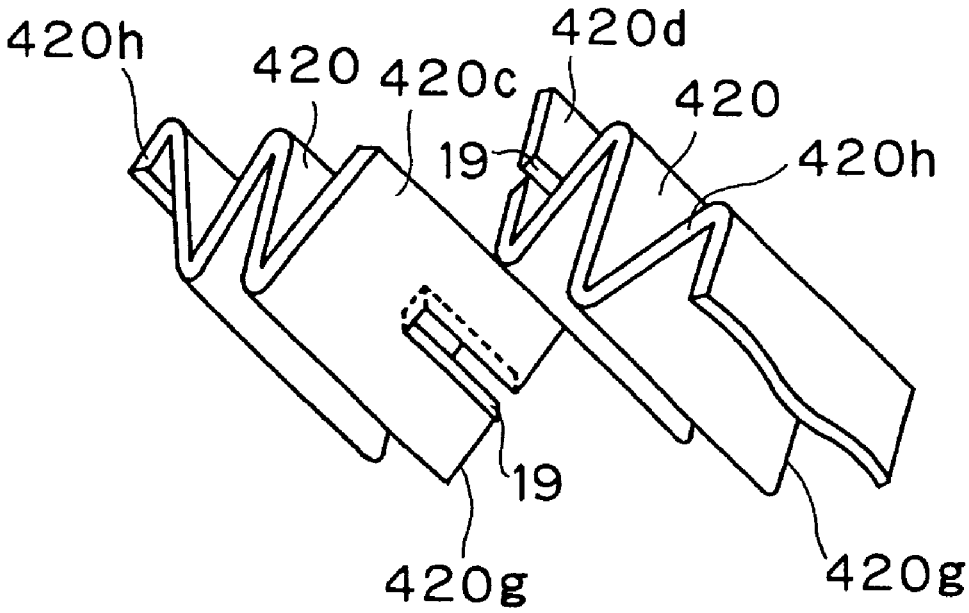
FIG. 17 is an enlarged perspective view of a principal portion of FIG. 16B.

First, the manufacturing method of the annular corrugate fin 421 used in this embodiment will be described. FIG. 16 shows the manufacturing procedure of the annular corrugate fin 421. FIG. 16A is a plan view of the linear corrugate fin 420, FIG. 16B is an enlarged plan view of the linear corrugate fin 420 in a rounded state with both ends thereof brought close together, and FIG. 14C is an enlarged plan view of the annular corrugate fin 421 in its finished state. FIG. 17 is a perspective view of a principal portion of FIG. 16B.

As FIG. 16A shows, the linear corrugate fin 420 has contiguous grooves 420*e* each having a V-shaped section. At both ends of the linear corrugate fin 420 are inverted-V-shaped grooves 420*b*. The endmost side 420*c* of the groove 420*a* and the endmost side 420*d* of the groove 420*b* are so formed that their length L6 is shorter than the length L of the slant sides between the tops and bottoms 420*f* and 420*f* of the grooves 420*e* in between. Moreover, as FIG. 17 shows, in the endmost sides 420*c* and 420*d*, slits 19 are respectively formed in such a way that one slit extends from one flank 420*g* of the linear corrugate fin 420 halfway inward and the other slit extends from the other flank 420*h* of linear corrugate fin 420 halfway inward.

The linear corrugate fin 420 is bent in the directions indicated by arrows F1 and F2 in FIG. 16A so as to be formed into a cylindrical shape so that the endmost sides 420*c* and 420*d* are put together (FIG. 16B). Then, the endmost sides 420*c* and 420*d* are coupled together by engaging together the slit 19 formed in the endmost side 420*c* and the slit 19 formed in the endmost side 420*d*. In this way, the annular corrugate fin 421 as shown in FIG. 16C is produced.

As FIGS. 2A and 15 show, the inner ring-shaped member 422 is placed in contact with the inner periphery of the annular corrugate fin 421 so that they are coaxial with each other. Here, the diameter of the circle formed by smoothly connecting all the bottoms 421*b* of the annular corrugate fin 421 (i.e., the internal diameter of the annular corrugate fin 421) is made substantially equal to the external diameter of the inner ring-shaped member 422.

The annular corrugate fin 421 and the inner ring-shaped member 422 are joined together with a ring-shaped brazing metal 13. Specifically, as FIG. 2B shows, the brazing metal 13 is placed where the annular corrugate fin 421 and the inner ring-shaped member 422 make contact with each other and is heated so that the molten brazing metal 13 flows down along the bottoms 421*b* of the annular corrugate fin 421.

As a result, as FIG. 3 shows, the brazing metal 13 is applied substantially evenly to where the annular corrugate fin 421 and the inner ring-shaped member 422 make contact with each other. When the brazing metal 13 hardens, the annular corrugate fin 421 and the inner ring-shaped member 422 are joined together and thereby integrated together. Instead of brazing specifically mentioned above, soldering or the like may be used.

The heat exchanger element 42 described above is inserted into a body 41 shown in FIG. 1 so that they are coaxial with each other, and thereby the heat rejector 4 is produced. The heat exchanger element 42 is inserted into the body 41 by the following mechanism. As shown in FIG. 4, which is a sectional outline of the body 41 and the heat exchanger element 42, both ends of the body 41 are tapered so that the wall thickness thereof becomes smaller towards the ends along the axis thereof (these portions are referred to as the tapered portions 41*a*).

Moreover, the external diameter of the heat exchanger element 42 (i.e. the external diameter of the annular corrugate fin 421) R1 ($=\phi B$) is made slightly smaller than the maximum internal diameter R2 ($=\phi B+\alpha_1$) of the body 41 at both ends thereof, and slightly greater than the internal diameter R3 ($=\phi B-\alpha_2$) of the body 41 in the portion thereof between the tapered portions 41*a*.

Thus, when the heat exchanger element 42 is inserted into the heat exchanger element 42 from one end thereof, the insertion requires a small force at first. Since the internal diameter of the body 41 gradually becomes smaller until it eventually becomes smaller than the external diameter R1 of the heat exchanger element 42, as the heat exchanger element 42 is inserted, the force required to do so gradually increases. In this way, the heat exchanger element 42 can be inserted into the body 41 easily.

Here, since the bottoms 421*b* of the annular corrugate fin 421 are fixed to the inner ring-shaped member 422, the annular corrugate fin 421 thus fitted into the body 41, of which the internal diameter R3 is smaller than the external diameter R1 of the annular corrugate fin 421, is brought into a state in which the grooves 421*a* are so pressed as to be wider open, and this produces a resilient force acting radially outward.

Moreover, since the external diameter R1 of the annular corrugate fin 421 and the depth of the grooves 421*a* are constant along the axis, the aforementioned resilient force presses the heat exchanger element 42 onto the inner surface of the body 41 with a uniform force all around and thereby keeps it in position. Here, the annular corrugate fin 421 and the inner ring-shaped member 422 are firmly fixed together, and thus are not deformed.

As described above, in this embodiment, the inner ring-shaped member 422 can be fixed in the desired position inside the body 41 without the use of adhesive or solder. This helps simplify the manufacturing procedure and reduce the manufacturing cost, and also stabilize the heat exchange performance of the heat exchanger member.

Moreover, when the annular corrugate fin 421 is damaged, the heat exchanger element 42 can be taken out of and removed from the body 41. This permits easy replacement as required, and thus helps alleviate the economic burden on the user in the event of repair and solve recycling problems.

Furthermore, in the heat exchanger element 42 used in this embodiment, the annular corrugate fin 421 and the inner ring-shaped member 422 are integrated together by brazing, soldering, or the like, and thus exhibit better thermal conductivity than when they are left unintegrated. This helps increase heat exchange efficiency.

Figure 18:
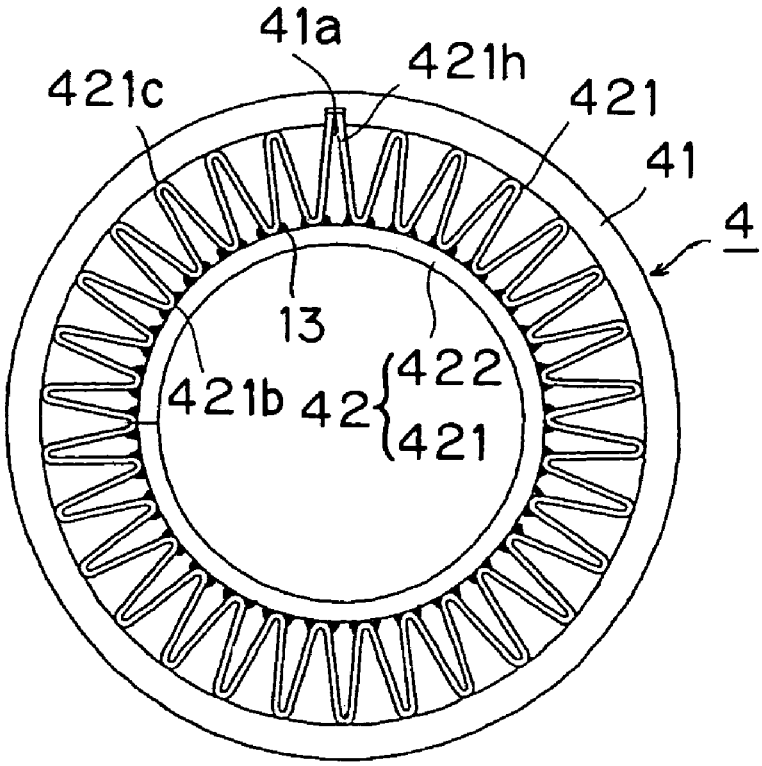
FIG. 18 is an enlarged plan view of the heat rejector of a seventh embodiment of the invention, as seen axially.

Next, a seventh embodiment of the invention will be described. FIG. 18 is a plan view of the heat rejector 4 of this embodiment, as seen axially. The heat rejector 4 of this embodiment, like that of the first embodiment described earlier, is composed of a heat exchanger element 42, consisting of an annular corrugate fin 421 and an inner ring-shaped member 422 brazed inside it, and a body 41 into which the heat exchanger element 42 is fitted.

Figure 19A:
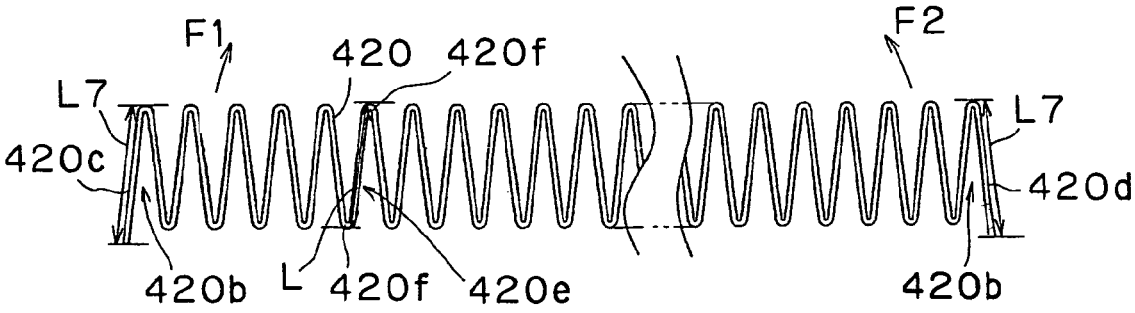
FIG. 19A is a plan view of the linear corrugate fin.
Figure 19B:
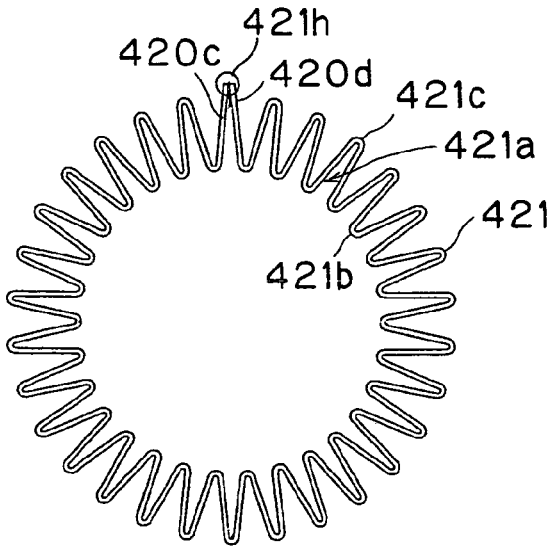
FIG. 19B is a plan view of the annular corrugate fin formed by rounding the linear corrugate fin and putting both ends thereof together.
Figure 19C:
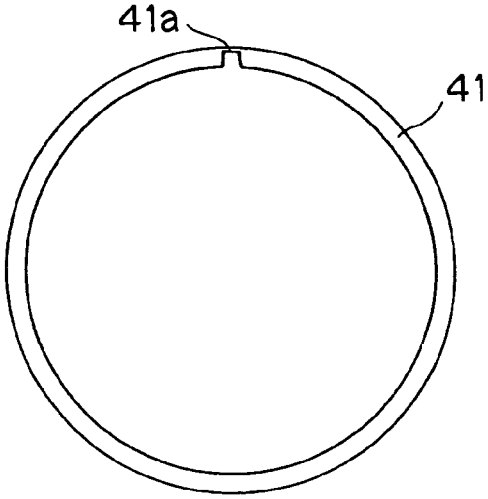
FIG. 19C is a top view of the cylindrical body.

First, the manufacturing method of the annular corrugate fin 421 used in this embodiment will be described. FIGS. 19A to 19C show the manufacturing procedure of the annular corrugate fin 421. FIG. 19A is a plan view of the linear corrugate fin 420, FIG. 19B is a plan view of the annular corrugate fin formed by rounding the linear corrugate fin and putting both ends of thereof together, and FIG. 19C is a top view of the cylindrical body 41.

As FIG. 19A shows, the linear corrugate fin 420 has contiguous grooves 420*e* each having a V-shaped section. At both ends of the linear corrugate fin 420 are inverted-V-shaped grooves 420*b*. The endmost side 420*c* of the groove 420*a* and the endmost side 420*d* of the groove 420*b* are so formed that their length L7 is longer than the length L of the slant sides between the tops and bottoms 420*f* and 420*f* of the grooves 420*e* in between.

The linear corrugate fin 420 is bent in the directions indicated by arrows F1 and F2 in FIG. 19A so as to be formed into a cylindrical shape so that the endmost sides 420*c* and 420*d* are put together. Then, the linear corrugate fin 420 is held in a state in which the endmost sides 420*c* and 420*d* are kept in contact with each other at least at their tips. In this way, the annular corrugate fin 421 as shown in FIG. 19B is produced. As a result, the tip portions of the endmost sides 420*c* and 420*d* form a protruding portion 421*h* that protrudes radially out of the outer periphery of the annular corrugate fin 421 (i.e., the circle formed by smoothly connecting all the tops 421*c*).

The internal diameter of the cylindrical body 41 is made substantially equal to the external diameter of the annular corrugate fin 421. Moreover, as FIG. 19C shows, in one position in the inner surface of the body 41, a groove 41*a* into which to fit the protruding portion 421*h* of the annular corrugate fin 421 is formed so as to extend axially.

The annular corrugate fin 421 is then inserted axially into the body 41 with the center of the former aligned with the center axis of the latter and with the protruding portion 421*h* of the former fit into the groove 41*a* of the latter. Here, as FIG. 1 shows, the annular corrugate fin 421 is inserted until one end thereof becomes flush with the open end of the body 41.

On the protruding portion 421*h* of the annular corrugate fin 421 acts a force that tends to bring the annular corrugate fin 421 back into the original state of the linear corrugate fin 420. However, since the protruding portion 421*h* is trapped in the groove 41*a*, the force converts to a force that tends to expand the annular corrugate fin 421 radially. Thus, the annular corrugate fin 421 expands radially, and is thereby pressed onto the inner surface of the body 41. This makes it possible to keep the annular corrugate fin 421 in the desired position while maintaining its shape.

On the other hand, the external diameter of the cylindrical inner ring-shaped member 422 is made substantially equal to the internal diameter of the annular corrugate fin 421 (i.e., the diameter of the circle formed by smoothly connecting all the bottoms 2*b*). The inner ring-shaped member 422 is inserted axially into the annular corrugate fin 421 with the center of the former aligned with the center axis of the latter. Then, the annular corrugate fin 421 and the inner ring-shaped member 422 are integrated together by brazing them together at where the inner periphery of the former makes contact with the outer surface of the inner ring-shaped member 422. In this way, the heat exchanger element 42 is fitted into the body 41, and thereby the heat rejector 4 is obtained as shown in FIG. 18.

Thus, it is possible to eliminate the process of bonding or welding the annular corrugate fin 421 to the body 41. This enhances productivity. Moreover, it is possible to fix the annular corrugate fin 421 securely by press fitting, and achieve uniform contact all round the annular corrugate fin 421. This helps manufacture the heat rejector 4 stably with excellent performance.

Figure 20:
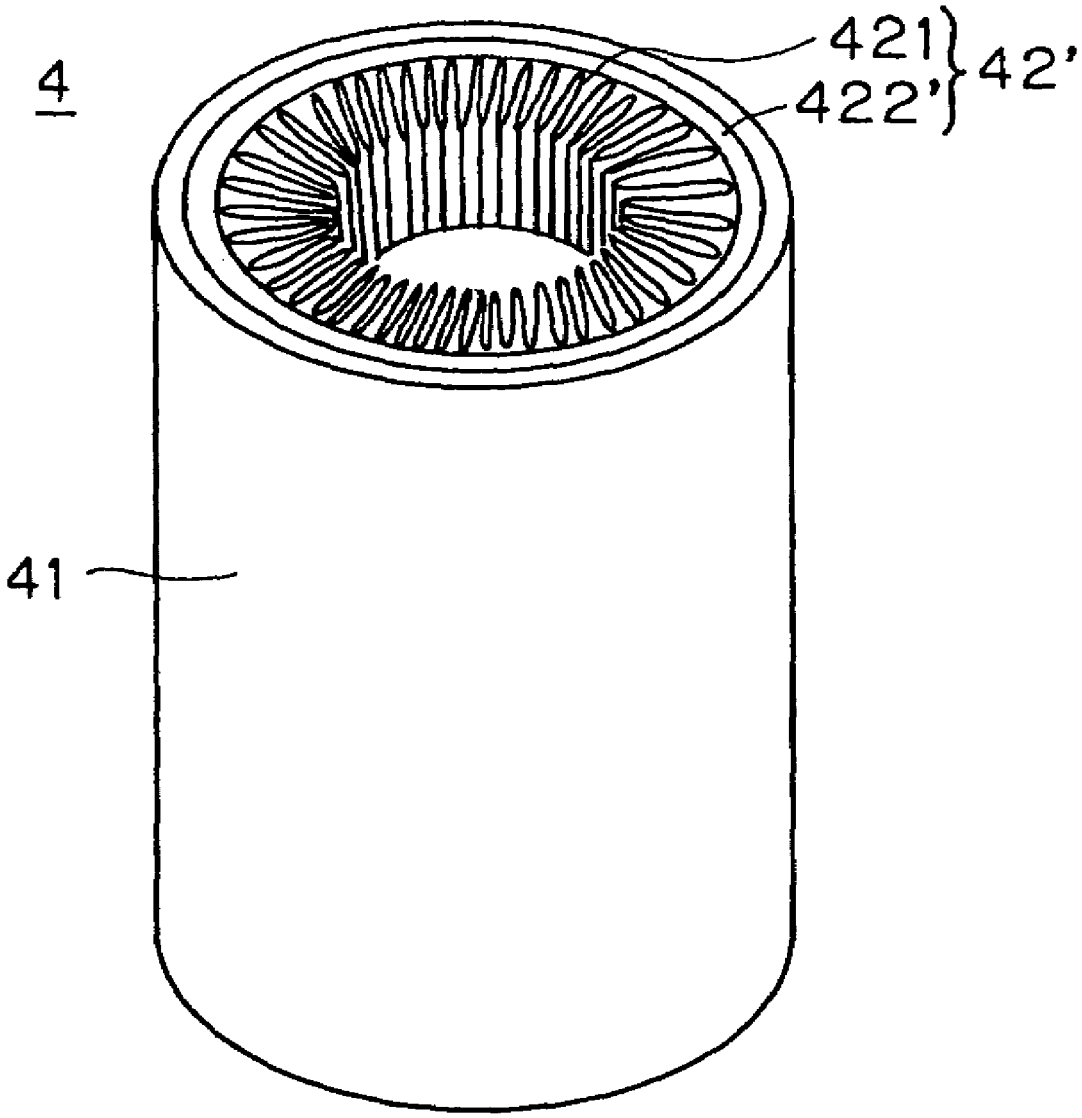
FIG. 20 is an external perspective view of a portion of the heat rejector of an eighth embedment of the invention.
Figure 21A:
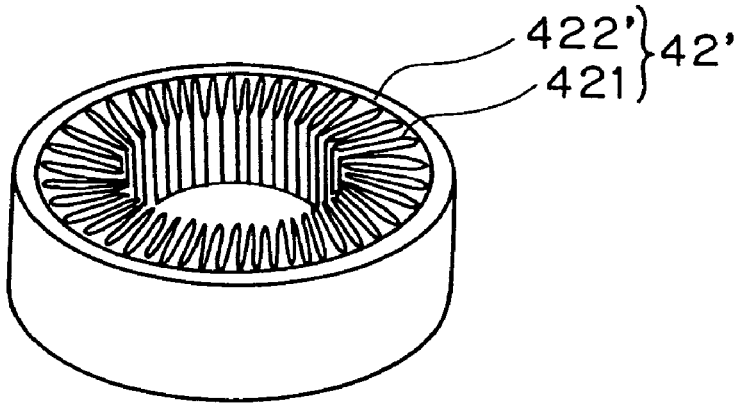
FIG. 21A is an external perspective view of the heat exchanger element of the heat rejector.
Figure 21B:
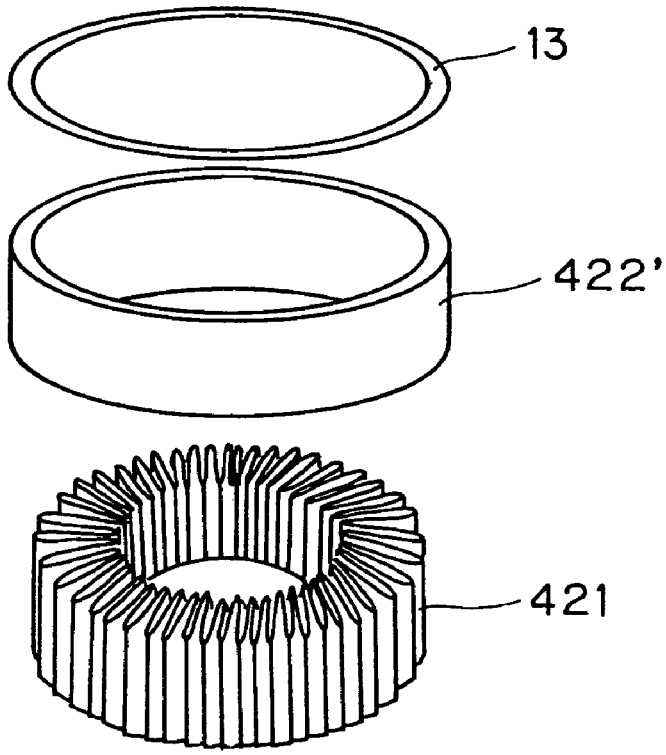
FIG. 21B is an exploded perspective view of the heat exchanger element.

Next, an eighth embodiment of the invention will be described. FIG. 20 is an external perspective view of the heat rejector 4 serving as a heat exchanger member in this embodiment. FIG. 21A is an external perspective view and an exploded perspective view, respectively, of the heat exchanger element 42' incorporated in the heat rejector 4.

This heat exchanger element 42' is composed of an annular corrugate fin 421 and an outer ring-shaped member 422'. The annular corrugate fin 421 is produced by the same procedure as described earlier in connection with the first to seventh embodiments. The outer ring-shaped member 422' is a cylindrical member made of a material having good thermal conductivity and resilience.

Figure 22:
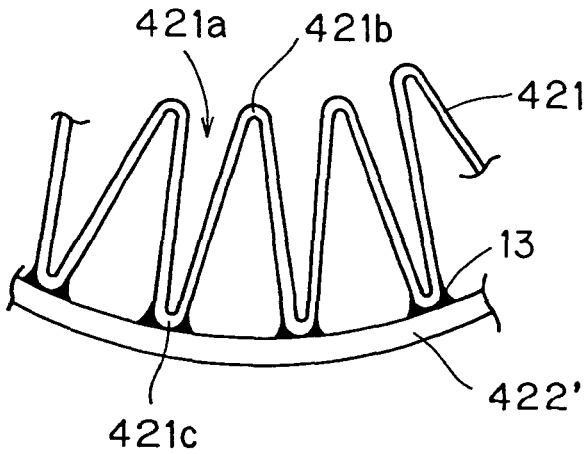
FIG. 22 is an enlarged plan view of a portion of the heat exchanger element, as seen axially.

As FIG. 21A shows, the outer ring-shaped member 422' is placed in contact with the outer periphery of the annular corrugate fin 421 so that they are coaxial with each other. Here, the external diameter of the annular corrugate fin 421 is made substantially equal to the internal diameter of the outer ring-shaped member 422'. Moreover, as FIG. 22 shows, the annular corrugate fin 421 and the outer ring-shaped member 422' are, like the annular corrugate fin 421 and the inner ring-shaped member 422 of the first embodiment, bonded together and fixed together with a brazing metal 13 or solder.

Figure 23:
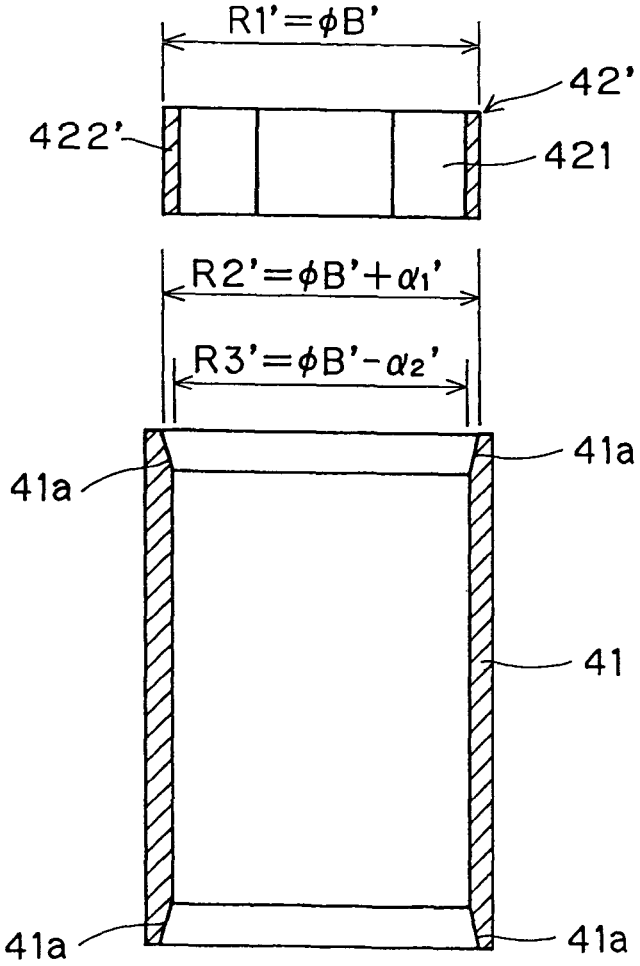
FIG. 23 is a vertical sectional outline of the body and the heat exchanger element of the heat rejector.

The heat exchanger element 42' described above is inserted into a body 41 shown in FIG. 20 so that they are coaxial with each other, and thereby the heat rejector 4 is produced. The heat exchanger element 42' is inserted into the body 41 by the following mechanism. As shown in FIG. 23, which is a sectional outline of the body 41 and the heat exchanger element 42', both ends of the body 41 are tapered in the same way as in the first embodiment (these portions are referred to as the tapered portions 41*a*).

Moreover, the external diameter of the heat exchanger element 42' (i.e. the external diameter of the outer ring-shaped member 422') R1' ($=\phi B'$) is made slightly smaller than the maximum internal diameter R2' ($=\phi B'+\alpha_1'$) of the body 41 at both ends thereof, and slightly greater than the internal diameter R3' ($=\phi B'-\alpha_2'$) of the body 41 in the portion thereof between the tapered portions 41*a*.

Thus, as in the first embodiment described earlier, the tapered portions 41*a* permit the heat exchanger element 42' to be inserted into the body 41 easily. Moreover, the heat exchanger element 42' thus fitted into the body 41 is pressed onto the inner surface of the body 41 and is thereby kept in position by the resilience that occurs in the annular corrugate fin 421 and the outer ring-shaped member 422'. Here, the annular corrugate fin 421 and the outer ring-shaped member 422' are firmly fixed together, and thus are not deformed.

As described above, in this embodiment also, the heat exchanger element 42' can be fixed in the desired position inside the body 41 without the use of adhesive or solder. Moreover, since the heat exchanger element 42' and the body 41 are not fixed together, the former can be taken out of the latter freely. Moreover, since the annular corrugate fin 421 and the outer ring-shaped member 422' are integrated together, they exhibit still better thermal conductivity.

Figure 24:
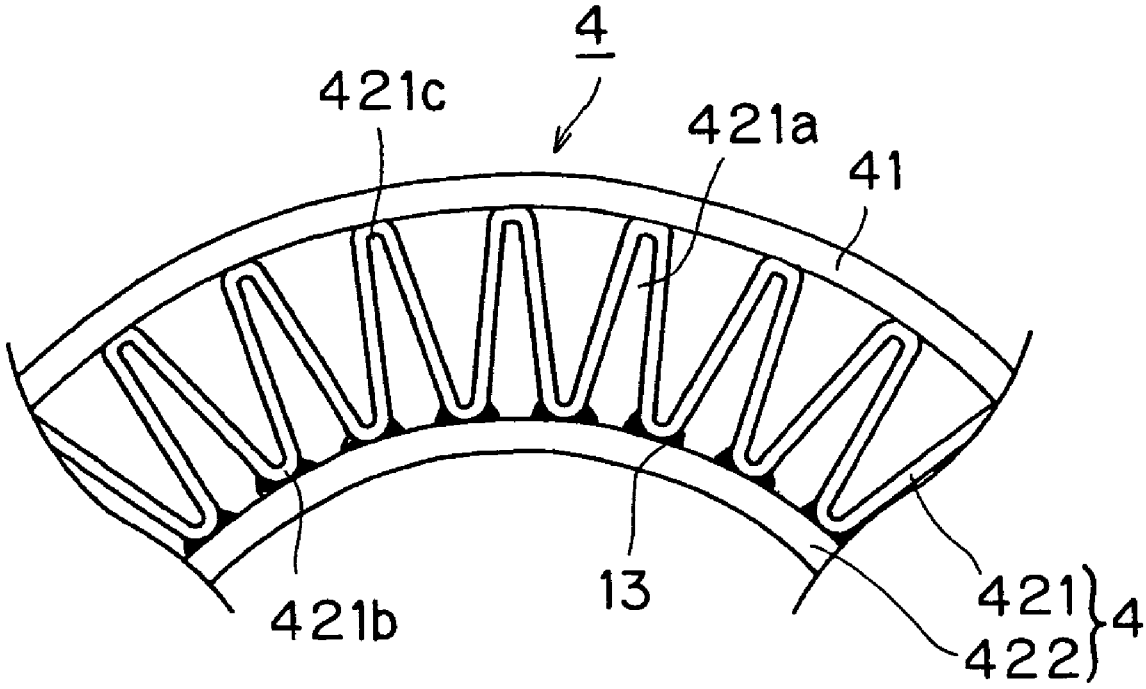
FIG. 24 is an enlarged plan view of a portion of the heat rejector of a ninth embodiment of the invention, as seen axially.
Figure 25A:
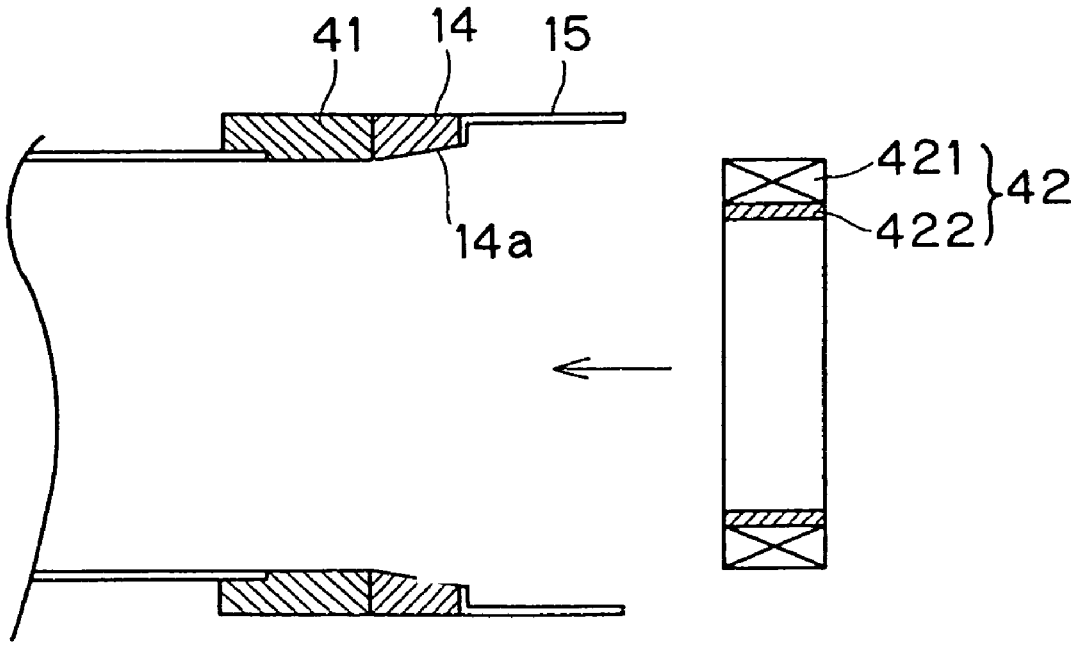
FIG. 25A is a sectional view of the heat rejector before the heat exchanger element is inserted into it from the guide member side thereof.
Figure 25B:
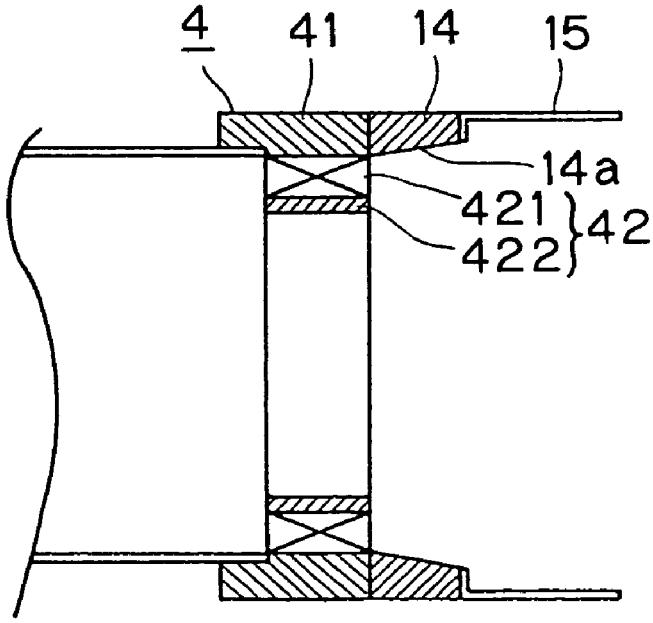
FIG. 25B is a sectional view of the heat rejector after the heat exchanger element is inserted into it.

Next, a ninth embodiment of the invention will be described with reference to the drawings. FIG. 24 is an enlarged plan view of a portion of the heat rejector 4 of the embodiment, as seen axially. FIG. 25 shows part of the manufacturing procedure of the heat rejector 4; specifically, FIGS. 25A and 25B are respectively sectional views of the heat rejector before and after the heat exchanger element 42 is inserted into it from the guide member side thereof.

As FIGS. 25A and 25B show, a cylindrical body 41 is fixed, together with a guide member 14, to a jig 15, with the axis of the body 41 kept substantially horizontal. The guide member 14 is provided so as to abut the body 41, and has an external diameter substantially equal to that of the body 41. The guide member 14 is so formed as to have a tapered cross section inside, forming a tapered portion 14*a*, so that its internal diameter is equal to the internal diameter of the body 41 at the joint and increases away therefrom.

Now, the manufacturing procedure of the heat rejector 4 of this embodiment will be described with reference to FIGS. 25A and 25B. An annular corrugate fin 421 is produced in the same manner as described earlier in connection with the first to sixth embodiments, i.e. by forming a linear corrugate fin 420 into a cylindrical shape and putting both ends thereof together. The annular corrugate fin 421 is made of a highly flexible material that is easily deformed when an external force is applied thereto.

In advance, an inner ring-shaped member 422, of which the external diameter is made slightly greater than the internal diameter of the annular corrugate fin 421, has been inserted axially into the annular corrugate fin 421 to produce the heat exchanger element 42. Then, as FIG. 25A shows, the heat exchanger element 42 is inserted axially into the guide member 14 from the open end thereof. Thus, the annular corrugate fin 421 is pushed gradually in through the tapered portion 14*a* of the body 41, i.e., from the portion thereof having a greater internal diameter to the portion thereof having a smaller internal diameter.

Then, as FIG. 25B shows, the insertion is stopped when one end surface of the annular corrugate fin 421 becomes flush with the joint between the body 41 and the guide member 14. Meanwhile, the tops 421*c* of the annular corrugate fin 421 rub against the inner surface of the guide member 14, and they are thereby deformed from arc-shaped to flat. The degree of this deformation is commensurate with how much the material of the guide member 14 is harder than the material of the annular corrugate fin 421. As FIG. 24 shows, this increases the area of contact between the annular corrugate fin 421 and the inner surface of the body 41. This helps enhance the efficiency with which heat is transmitted from the annular corrugate fin 421 to the body 41 and thereby enhance the heat exchange performance of the heat rejector 4.

Figure 26:
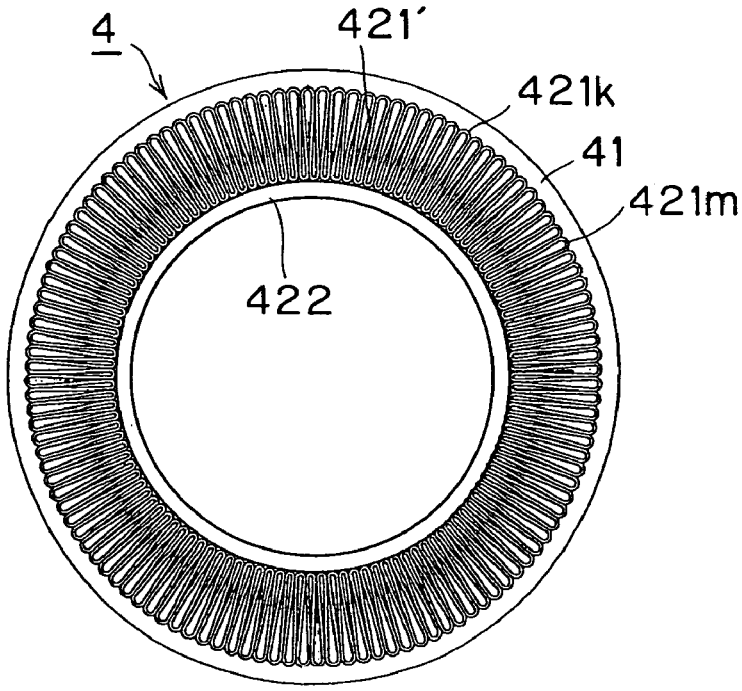
FIG. 26 is a plan view of the heat rejector of a tenth embodiment of the invention.

Next, a tenth embodiment of the invention will be described with reference to the drawings. FIG. 26 is a plan view of the heat rejector 42 of this embodiment, FIG. 27 is a plan view of the heat exchanger element 42, and FIG. 28 is a plan view of the cylindrical body.

Around the outer periphery of an annular corrugate fin 421', round, wave-shaped projections 421*k* are formed so as to be in close contact with one another and at regular intervals overall. On the other hand, a body 41 is produced by pouring a molten metal into a mold and then cooling it.

Figure 28:
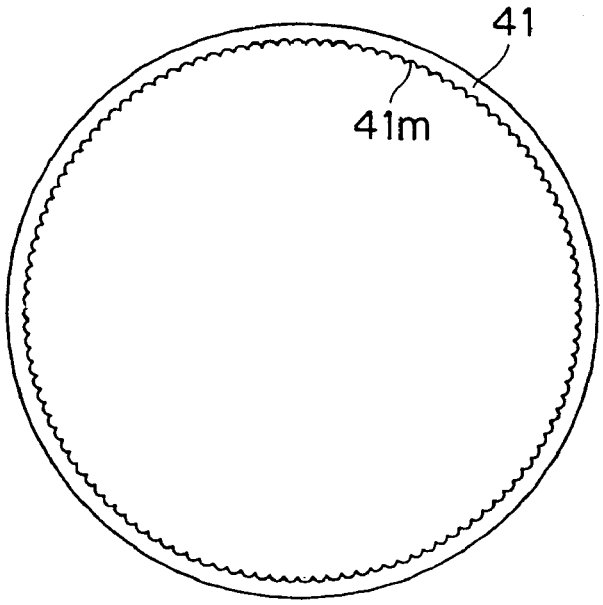
FIG. 28 is a plan view of the cylindrical body.
Figure 29:
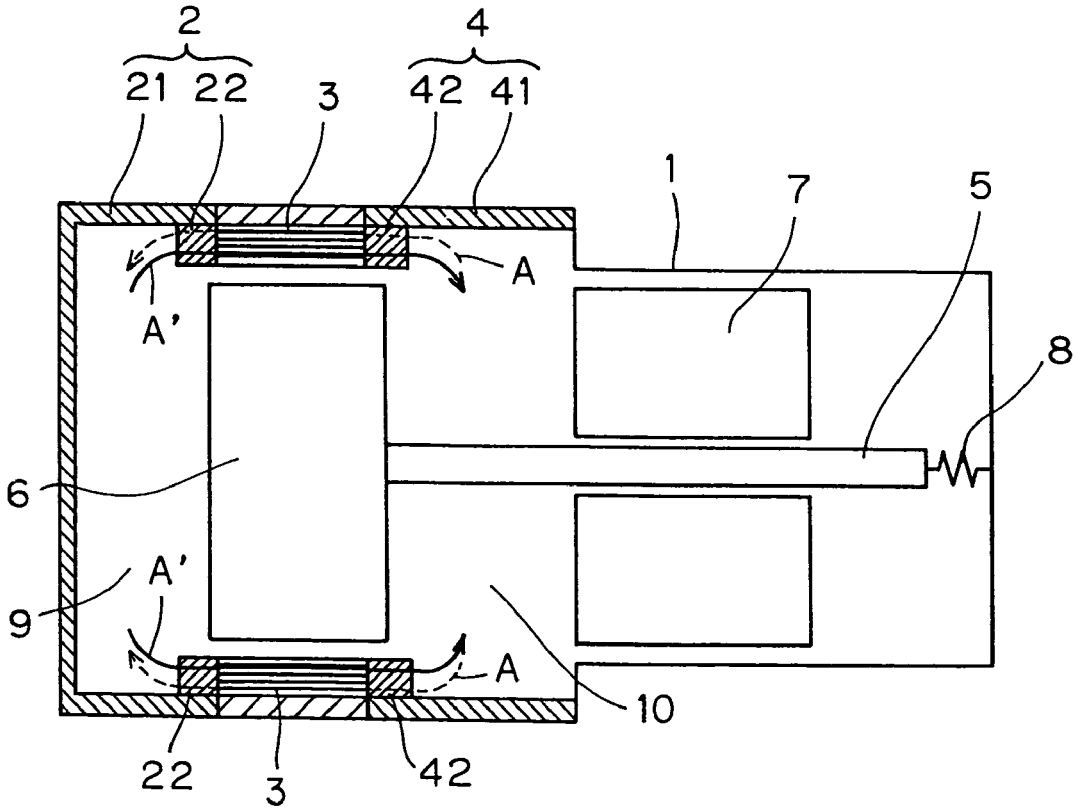
FIG. 29 is a sectional outline of a conventional free-piston-type Stirling cycle refrigerator.
Figure 30:
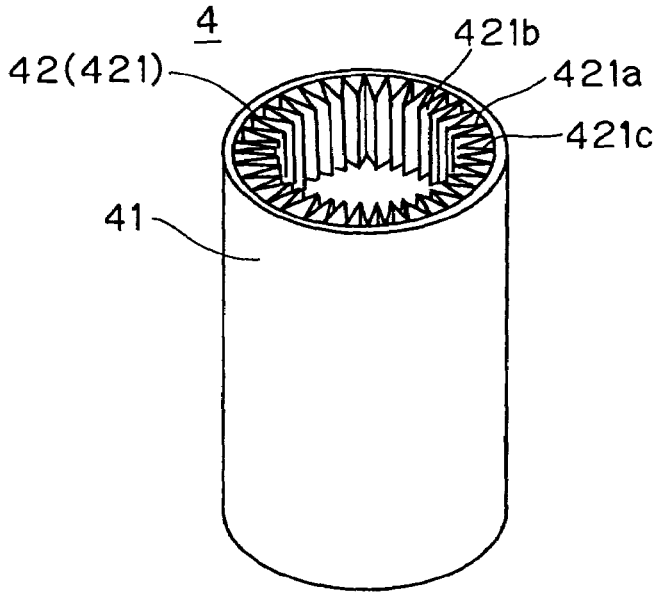
FIG. 30 is an external perspective view of a heat rejector as a conventional example of a heat exchanger member.
Figure 31:
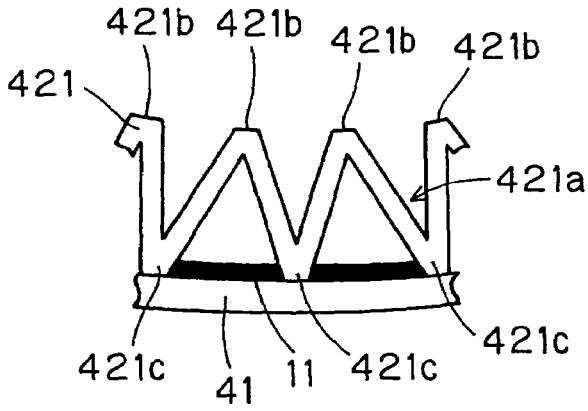
FIG. 31 is an enlarged plan view of a portion of an example of a conventional heat exchanger element, as seen axially.
Figure 32:
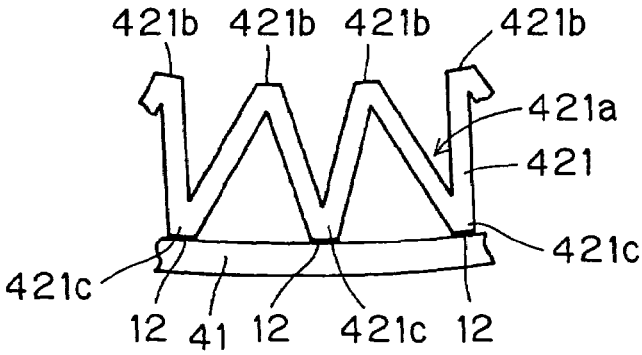
FIG. 32 is an enlarged plan view of a portion of an example of another conventional heat exchanger element, as seen axially.

As FIG. 28 shows, the body 41 has wave-shaped depressions 41*m* formed at regular intervals all around its inner surface so as to extend axially. These depressions 41*m* are so shaped that the aforementioned wave-shaped projections 421*k* of the annular corrugate fin 421' fit into them.

Figure 27:
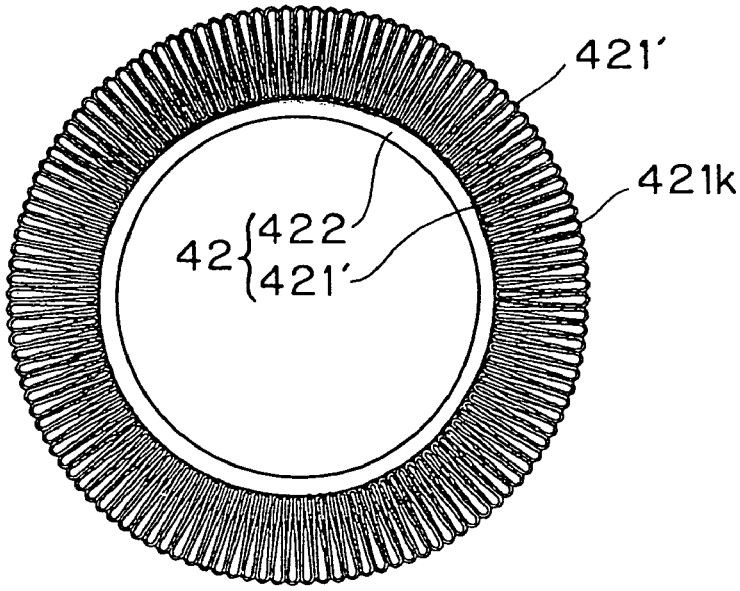
FIG. 27 is a plan view of the heat exchanger element of the heat rejector.

As FIG. 2A shows, in advance, an inner ring-shaped member 422, of which the external diameter is made slightly substantially equal to the internal diameter of the annular corrugate fin 421', has been inserted into the annular corrugate fin 421', and they have been brazed together at where they make contact with each other, in order to produce the heat exchanger element 42 shown in FIG. 27. Then, as FIG. 4 shows, the heat exchanger element 42 is inserted axially into the body 41, with the center of the former aligned with the center axis of the latter. Here, as FIG. 26 shows, the projections 421*k* of the annular corrugate fin 421' fit into the depressions 41*m* of the body 41. This ensures that, in the heat rejector 4, the heat exchanger element 42 is kept securely in position circumferentially inside the body 41. Thus, in this embodiment, it is possible to keep the annular corrugate fin 421' in firm and close contact with the inner surface of the body 41, and thereby secure a sufficiently large area of contact all around the annular corrugate fin 421'. This helps manufacture the heat rejector 4 stably with excellent performance.

INDUSTRIAL APPLICABILITY

As described hereinbefore, according to the present invention, a heat exchanger element does not require bonding by hand when fitted into a body. This helps enhance the productivity of a heat exchanger member and reduce its manufacturing cost. Moreover, the heat exchanger member thus manufactured is less prone to variations in quality, and therefore offers stable heat exchange performance.

Moreover, in a heat exchanger element, a corrugate fin and an inner or outer ring-shaped member are integrated together. This enhances heat conductivity and thus heat exchange efficiency.

Moreover, a heat exchanger element is kept in position inside the body of a heat exchanger member by press fitting. This makes it possible to take the heat exchanger element out of the body and remove it therefrom. Thus, even if the corrugate fin is damaged, lowering the quality of the heat exchanger element, it is possible to replace the corrugate fin easily as required. This makes the heat exchanger element very economical and recyclable.

In particular, in an arrangement in which the body of a heat exchanger member is tapered at an end, a heat exchanger element can be inserted into it smoothly even when the external diameter of the heat exchanger element is greater than the internal diameter of the body.

Moreover, an annular corrugate fin need not be fitted into a cylindrical body by hand by means of bonding or welding, but can be securely kept in position by press fitting simply by inserting the former into the latter. This helps enhance the productivity of the heat exchanger member. Moreover, uniform contact is achieved all around the annular corrugate fin. This makes it possible to manufacture the heat exchanger member stably with excellent performance.

The invention claimed is:

1. The heat exchanger element for a Stirling cycle refrigerator, comprising:

an annular corrugate fin produced by forming a sheet material, corrugated so as to have a large number of grooves, into a cylindrical shape with the grooves parallel to an axis of the cylindrical shape; and an inner ring-shaped member placed in contact with an inner periphery of the annular corrugate fin, wherein the annular corrugate fin is integrally attached to the inner ring-shaped member;

wherein the annular corrugate fin is formed such that an external diameter of the annular corrugate fin is slightly larger than an internal diameter of the tubular body prior to insertion of the corrugate fin into the tubular body, and wherein at least one end of the tubular body is tapered so that the internal diameter of the body becomes greater toward that end along the axis, a maximum internal diameter of the taper is greater than the external diameter of the annular corrugate fin, and the annular corrugate fin is inserted into the taper axially from an end thereof.

2. A heat exchanger element for a Stirling cycle refrigerator, comprising:

an annular corrugate fin produced by forming a sheet material, corrugated so as to have a large number of grooves, into a cylindrical shape with the grooves parallel to an axis of the cylindrical shape an inner ring-shaped member placed in contact with an inner periphery of the annular corrugate fin, wherein the annular corrugate fin is integrally attached to the inner ring-shaped member; and a tubular body in a shape of a hollow cylinder that is endless in a direction of a circumference thereof, the tubular body having a hollow portion that removably receives the annular corrugate fin by making contact an outer periphery of the annular corrugate fin and opposite end portions, wherein the annular corrugate fin is press-fitted into the hollow portion of the tubular body through one end portion thereof, and is kept in pressed contact with an inner periphery of the tubular body, and the annular corrugate fin is produced by forming a linear corrugate fin, having contiguous V-shaped grooves, into a cylindrical shape, and then coupling together an endmost side of a V-shaped groove at one end of the linear corrugate fin and an endmost side of an inverted-V-shaped groove at another end thereof.

* * * * *